US010750850B2

(12) United States Patent
Alvarez

(10) Patent No.: US 10,750,850 B2
(45) **Date of Patent: *Aug. 25, 2020**

(54) DOUBLE ACTION CLEANING TOOL

(71) Applicant: ALVAREZ & CASIAS, LLC, Lakeside, CA (US)

(72) Inventor: Salvador Alvarez, San Diego, CA (US)

(73) Assignee: ULTRA INDUSTRIES LLC

( * ) Notice: Subject to any disclaimer, the term of this patent is extended or adjusted under 35 U.S.C. 154(b) by 164 days.

This patent is subject to a terminal disclaimer.

(21) Appl. No.: 16/044,375

(22) Filed: Jul. 24, 2018

(65) Prior Publication Data

US 2019/0038012 A1 Feb. 7, 2019

Related U.S. Application Data

(63) Continuation-in-part of application No. 15/477,105, filed on Apr. 2, 2017, now Pat. No. 10,028,573, (Continued)

(51) Int. Cl.
*A46B 7/06* (2006.01)
*A46B 9/02* (2006.01)
(Continued)

(52) U.S. Cl.
CPC ..... *A46B 7/06* (2013.01); *A46B 5/0012* (2013.01); *A46B 7/02* (2013.01); *A46B 9/02* (2013.01);
(Continued)

(58) Field of Classification Search
CPC ..... A46B 5/0012; A46B 7/02; A46B 7/06; A46B 9/00; A46B 9/02; A46B 15/00;
(Continued)

(56) References Cited

U.S. PATENT DOCUMENTS 1,616,484 A 2/1927 Beynon
2,588,601 A 3/1952 Zavagno
(Continued)

FOREIGN PATENT DOCUMENTS

DE 592757 * 2/1934
DE 19821412 1/2000
EP 412060 2/1991

*Primary Examiner* — Mark Spisich
(74) *Attorney, Agent, or Firm* — Gary L. Eastman, Esq.; Eastman McCartney Dallmann LLP

(57) ABSTRACT

The double action cleaning tool of the present invention includes a dynamic double action dual brush head and a handle. The dynamic double action dual brush head includes two brush heads rotatably attached to a brush head base, allowing the brush heads to independently rotate about the axis in which it is rotatably attached to the brush head base. A mechanical device capable of storing and releasing energy is connected between the two brush heads, which is rigidly attached to the brush head base. The double action cleaning tool stores energy in the form of potential energy in the mechanical energy storage device of the dynamic double action dual brush head during the sweeping stroke of the double action push broom. At the end of the sweeping stroke, the stored potential energy is converted into kinetic energy and rotates the dual brush, thereby providing an additional sweeping motion.

8 Claims, 17 Drawing Sheets

Related U.S. Application Data which is a continuation of application No. 14/918,498, filed on Oct. 20, 2015, now Pat. No. 9,609,939.

(60) Provisional application No. 62/065,760, filed on Oct. 20, 2014.

(51) Int. Cl.

| | |
|---|---|
| ***A46D 3/04*** | (2006.01) |
| ***B25G 3/30*** | (2006.01) |
| ***A46B 5/00*** | (2006.01) |
| ***A46B 7/02*** | (2006.01) |

(52) U.S. Cl.

CPC ..... *A46D 3/04* (2013.01); *B25G 3/30* (2013.01); *A46B 2200/302* (2013.01)

(58) Field of Classification Search

CPC ... A46B 2200/302; A47L 13/20; A47L 13/24; A47L 13/254; A47L 13/255; A47L 13/256; A47L 13/257; A47L 13/258

USPC ..... 15/106, 159.1, 171, 172, 201, 203; D4/119, 121, 130; D32/50

See application file for complete search history.

(56) References Cited

U.S. PATENT DOCUMENTS

| | | | |
|---|---|---|---|
| 2,606,335 | A | 8/1952 | Wiesman |
| 2,614,281 | A | 10/1952 | Clark |
| 2,631,320 | A | 3/1953 | Bressler |
| 2,796,620 | A | 6/1957 | Bressler |
| 3,253,292 | A | 4/1966 | Herschensohn |
| 4,554,699 | A | 11/1985 | Simmons |
| 8,739,348 | B1 | 6/2014 | Currier |
| 2002/0152570 | A1 | 10/2002 | Hohlbein |
| 2005/0204498 | A1 | 9/2005 | Saunders |
| 2006/0254011 | A1 | 11/2006 | Jones et al. |

* cited by examiner

DOUBLE ACTION CLEANING TOOL

RELATED APPLICATIONS

This application is a continuation-in-part application of U.S. patent application Ser. No. 15/477,105 entitled "Double Action Push Broom" filed on Apr. 2, 2017, now U.S. Pat. No. 10,028,573, which is a continuation of U.S. patent application Ser. No. 14/918,498 entitled "Double Action Push Broom" filed on Oct. 20, 2015, now U.S. Pat. No. 9,609,939, which claims the benefit of priority to U.S. Provisional Patent Application Ser. No. 62/065,760 filed on Oct. 20, 2014, entitled "Double Action Push Broom," and currently co-pending.

FIELD OF THE INVENTION

The present invention relates generally to cleaning implements, and more specifically to cleaning tool. The present invention is more particularly, though not exclusively useful as double action brooms. The present invention is more particularly, though not exclusively useful as a push-type broom.

BACKGROUND OF THE INVENTION

The traditional broom is a cleaning implement widely used everywhere in the world. The basic structure of a broom has essentially been unchanged since it was first created. The traditional broom includes a handle and a brush head, and although technology has advanced, the basic structure has been maintained. Traditional brooms can be made with simple or complex, state of the art materials. A traditional broom may be made from a bundle of twigs tied together forming a stiff handle and a brush head, or made from state of the art materials such as thermoplastics, polymers and composites. Although the traditional broom is still widely used throughout the world, there have been slight variations to the traditional broom.

One variation of the traditional broom is the push-type broom created to handle heavy duty sweeping. The push-type broom, commonly referred to as the push broom, has a wide brush head with relatively short bristles, to which a handle is attached at an angle in the center of the brush head. The push broom brush is typically wider to cover more surface area. The bristles are stiff to allow the movement of heavier and larger amount of debris. The handle is angled to allow a user to apply a larger force to the broom enabling the push broom to push larger amounts of debris.

Another variation of a type of cleaning tool similar to a push broom is the dust mop. The dust mop is similar to the push broom, but instead of a wide brush head with relatively short bristles the dust mop includes a wide brush head with a removable dust mop head made of soft fibers. The soft fibers may be cotton, microfiber, or any other material used to pick up dust.

Yet another variation of a type of cleaning tool similar to a push broom is the push-type broom with disposable cleaning pad attachments. The push-type broom with disposable cleaning pad is similar to the push broom, but instead of a wide brush head with relatively short bristles the push-type broom with disposable cleaning pad includes a wide brush head with a removable cleaning pad attached to the wide brush head. The removable cleaning pad may have a variety of cleaning surfaces, such as cotton, microfiber, electrostatic cleaning sheets, or any other material used to clean floors.

However, the push broom has its limitations and drawbacks. As result of its large brush head and the location of the broom handle at the center, the distribution of force across the brush head is unequal. This allows debris to escape from the bristles at the edges of the push broom. The debris also tends to lodge itself within the bristles of the push broom which then requires the user to exert additional force or physical interaction with the broom to dislodge the debris, such as tapping or scraping the brush head. Further, the bristles of the large brush head are spaced with large gaps that allow debris to slip past the bristles. This requires a user to continually push the push broom over the same area to ensure that all of the debris has been swept up and that no debris has slipped through the gaps. The limitations and drawbacks of the push broom are also present in other types of cleaning tools, including the push-type broom with disposable cleaning pad attachments and dust mops.

In light of the above, it would be advantageous to provide a push type cleaning tool with a dynamic head capable of providing an additional sweeping motion at the end of a user's sweeping stroke. It would further be advantageous to provide a cleaning tool with a dynamic head capable of rotating from a first position to a second position where the dynamic head returns to the first position from the second position automatically. In light of the above, it would be advantageous to provide a push type cleaning tool with a dynamic brush head capable of providing an additional sweeping motion at the end of a user's sweeping stroke. It would further be advantageous to provide a push type cleaning tool with a dynamic brush head capable of rotating from a first position to a second position where the dynamic brush head returns to the first position from the second position automatically.

SUMMARY OF THE INVENTION

The double action cleaning tool of the present invention is designed to improve the effectiveness of a cleaning tool by incorporating a dynamic double action dual head which automatically provides an additional sweeping motion at the end of a sweep stroke. The double action push broom of the present invention is designed to improve the effectiveness of a push broom by incorporating a dynamic double action dual brush head which automatically provides an additional sweeping motion at the end of a sweep stroke.

In a preferred embodiment, the double action cleaning tool is a double action push broom that includes a dynamic double action dual brush head and a broom handle. The dynamic double action dual brush head includes two brush heads rotatably attached to a brush head base. This allows the brush head to rotate about the axis in which it is rotatably attached to the brush head base, with each brush head rotating independent of the other. A mechanical device capable of storing and releasing energy is connected between the two brush heads, which is rigidly attached to the brush head base. In the preferred embodiment, the mechanical device is a torsion spring with two moment arms, each arm extending to and contacting a corresponding brush head. The torsion spring is prefabricated with a spring constant and predetermined angle between the two moment arms. The angle of the moment arms maintains the brush heads at a brush head angle at all times. The use of a torsion spring as the mechanical energy storage device for the dynamic dual brush head is not meant to be limiting and it is contemplated that other types of mechanical energy storage devices may be used such as a leaf spring, a flat spring, a cantilever spring, or other various types of springs or spring-like materials without departing from the scope and spirit of the invention.

The double action push broom stores kinetic energy in the form of potential energy in the mechanical energy storage device of the dynamic double action dual brush head during the sweeping stroke of the double action push broom. During the sweeping motion, the dual brush head rotates to a maximum angle and is maintained until the sweeping stroke ends. At the end of the sweeping stroke, the stored potential energy is converted into kinetic energy and rotates the dual brush heads towards its initial position, thereby providing an additional sweeping motion. The additional sweeping motion pushes the debris swept by each brush head towards the center of the push broom and provides additional force to loosen any debris stuck in the bristles of the brush heads. Further, the additional sweeping motion sweeps the area where the sweeping stroke ends, ensuring any debris not picked up by the user's stroke is picked up by the sweeping motion of the dynamic double action dual brush head. The additional sweeping motion dramatically improves the effectiveness of the double action push broom over traditional push brooms.

In an alternative embodiment, the double action cleaning tool is a push-type broom with disposable cleaning pad attachments, similar to a push broom. The push-type broom with disposable cleaning pad is similar to the push broom, but instead of a wide brush head with relatively short bristles the push-type broom with disposable cleaning pad includes a wide brush head with a removable cleaning pad attached to the wide brush head. The removable cleaning pad may have a variety of cleaning surfaces, such as cotton, microfiber, electrostatic cleaning sheets, or any other material used to clean floors.

In another alternative embodiment, the double action cleaning tool is a dust mop. The dust mop is similar to the push broom, but instead of a wide brush head with relatively short bristles the dust mop includes a wide brush head with a removable dust mop head made of soft fibers. The soft fibers may be cotton, microfiber, or any other material used to pick up dust.

In an alternative embodiment, the dynamic double action dual brush head includes a single brush head formed of an elastic material which enables each end of the brush head to move independently from one another. The choice of a proper elastic material allows for the brush head to flex as the double action push broom is being pushed during a sweeping stroke. The elastic material stores the kinetic energy in the form of potential energy through the flexure of the ends of the brush head. Once the sweeping stroke ends, the elastic material potential energy converts to kinetic energy and the brush head returns to its original shape, thereby providing the extra sweeping motion. As a result of the integrally formed brush head, there is only a single brush head; the dynamic double action dual brush head is a dynamic double action brush head.

BRIEF DESCRIPTION OF THE DRAWINGS

The nature, objects, and advantages of the present invention will become more apparent to those skilled in the art after considering the following detailed description in connection with the accompanying drawings, in which like reference numerals designate like parts throughout, and wherein.

DETAILED DESCRIPTION OF THE DRAWINGS

Figure 1:
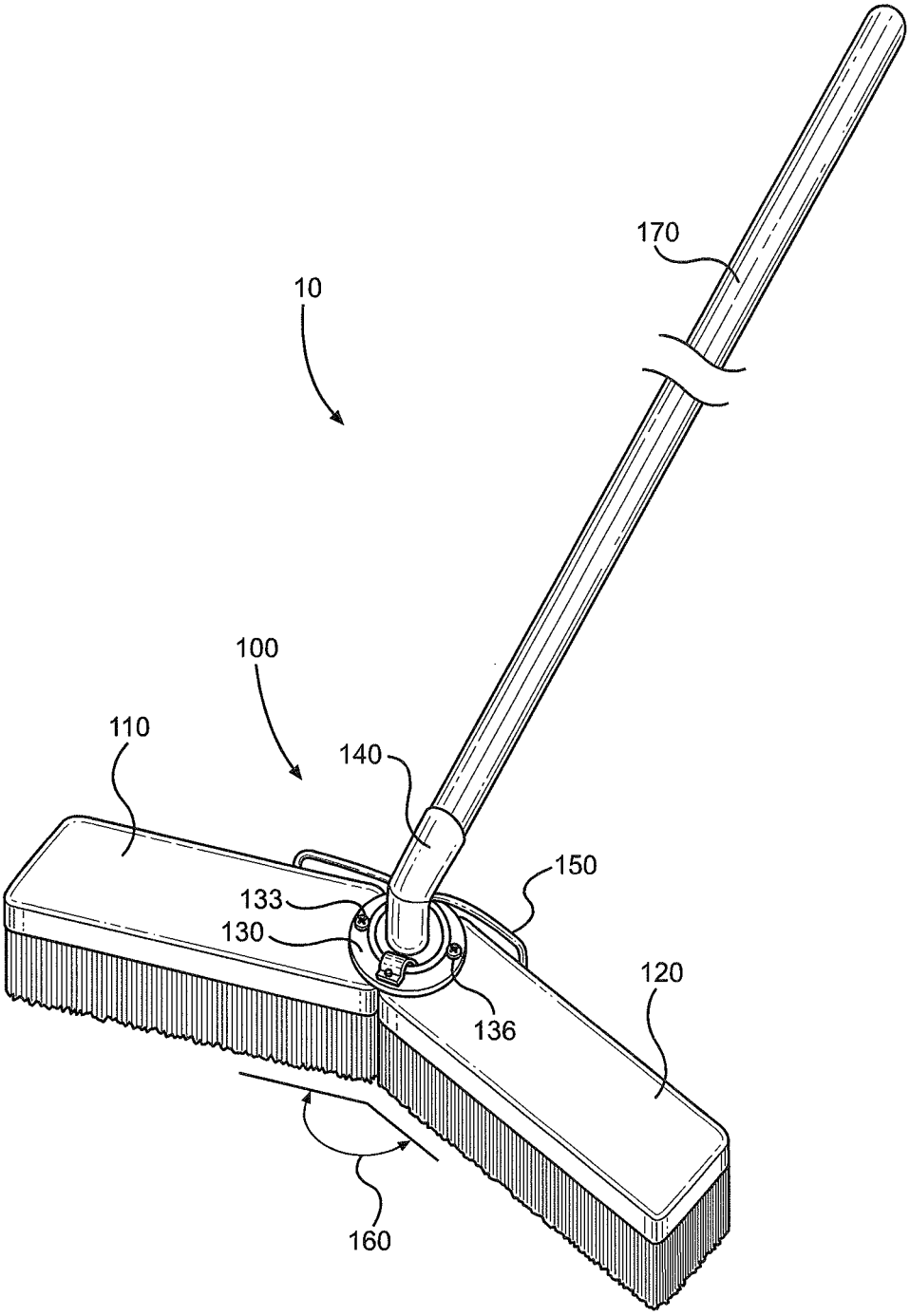
FIG. 1 is a front perspective view of the double action push broom of the present invention showing the dynamic double action dual brush heads.

Referring initially to FIG. 1, a preferred embodiment of the double action cleaning tool is a double action push broom of the present invention, which is shown and generally designated 10. The double action push broom includes a dynamic double action dual brush head 100 and a broom handle 170.

The dynamic double action dual brush head 100 includes two separate brush heads, a first brush head 110 and a second brush head 120 rotatably connected to a brush head base 130. A mechanical energy storage device is connected between the first brush head 110 and the second brush head 120 while rigidly connected to the brush head base 130. As shown, in the preferred embodiment the mechanical energy storage device is a torsion spring 150. It is contemplated that the torsion spring used as a mechanical energy storage device is not meant to be limiting and that various other types of mechanical energy storage devices may be used such as a flat spring, a leaf spring, a cantilever spring, or other types of mechanical energy storage devices without departing from the scope and spirit of the invention.

The first brush head 110 and the second brush head 120 is rotatably connected to the brush head base 130 by corresponding fasteners, 133 and 136 respectively. Fastener 133 provides an axis of rotation for the first brush head 110 and fastener 136 provides an axis of rotation for the second brush head 120. It is contemplated that bearings may be inserted into the first brush head 110 and the second brush head 120 where the fasteners 133 and 136, respectively, attach for smoother rotation. The torsion spring 150 is fixedly attached to the brush head base 130. The rest angle of the torsion spring 150 rotates the first brush head 110 and the second brush head 120 along each of their relative axis of rotation to a brush head angle 160. At rest, the brush head angle 160 is approximately equal to the resting angle of the torsion spring 150. The torsion spring 150 ensures the brush head angle 160 of the first brush head 110 and second brush head 120 returns to the rest angle when no force is acting on the first brush head 110 and the second brush head 120.

The rotation of the first brush head 110 and second brush head 120 rotates along their relative axis of rotation rotates which twists the torsion spring 150. When twisted, the torsion spring 150 exerts a force in the opposite direction of the rotation in proportion to the amount it is twisted. As a result, the torsion spring 150 stores the force as potential energy until it is converted into kinetic energy. When the force acting on the torsion spring 150 is no longer present, the torsion spring 150 converts the potential energy to kinetic energy. When this occurs, the kinetic energy from the torsion spring 150 rotates the first brush head 110 and second brush head 120, creating an additional sweeping motion which provides for a more effective push broom.

The additional sweeping motion of the dynamic double action dual brush head 100 provides an additional sweeping motion at the end of a user's sweeping stroke, which traditional push broom are not capable of providing. Further, the sweeping motion of the dynamic double action dual brush head 100 sweeps collected debris towards the center of the double action push broom 10 to allow better collecting of debris. Further the additional sweeping motion sweeps the area where the sweeping stroke ends, ensuring any debris not picked up by the user's stroke is picked up by the sweeping motion of the dynamic double action dual brush head 100. The additional sweeping motion dramatically improves the effectiveness of the double action push broom 10 over traditional push brooms which fail to adequately collect dirt at the edges of the push broom.

Figure 2:
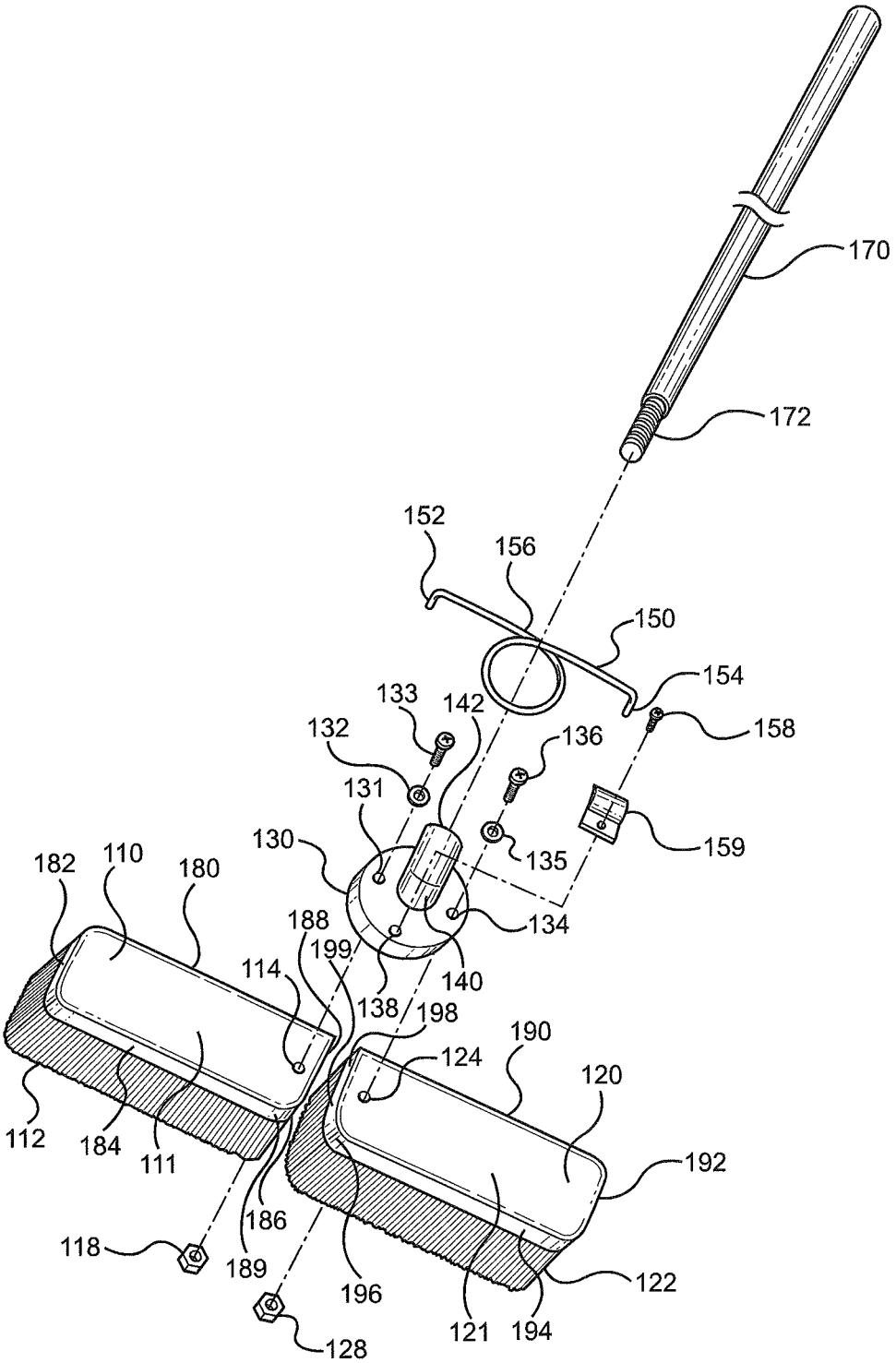
FIG. 2 is an exploded view of the double action push broom showing the individual parts which make up the present invention.

Referring now to FIG. 2, an exploded view of the preferred embodiment of the double action push broom 10 of the present invention is shown. The double action push broom 10 consists of a dynamic double action dual brush head 100 and a broom handle 170.

The dynamic double action dual brush head 100 includes two separate brush heads, a first brush head 110 and a second brush head 120 rotatably connected to a brush head base 130.

In the preferred embodiment, the brush head base 130 is flat metal plate in the shape of a circle. It is contemplated that the shape of the brush head base 130 is not limited to the shape of a circle, and that any shape may be utilized. The brush head base 130 is formed with a plurality of attachment points, a first brush head mounting point 131, a second brush head mounting point 134, and a spring mounting point 138. The first brush head mounting point 131 and second brush head mounting point 134 are collinear with the spring mounting point 138 located on a line perpendicular from each of the brush mounting points. At the center of the brush head base 130, handle mount 140 is fixedly attached to the brush head base 130. The handle mount 140 protrudes normal from the surface of the brush head base 130 and subsequently angles at a twenty-two (22) degree angle before terminating. The end of the handle mount 140 opposite the fixed end is formed with a threaded bore 142.

The first brush head 110 includes a base 111 with bristles 112 fixedly attached and extending normal therefrom. The bristles 112 are made of a firm, flexible and durable material such as polyethylene terephthalate (PET), polypropylene, or any other material having similar physical characteristics and properties. The physical characteristics and properties of the bristles 112 may be modified to accommodate different surfaces and uses. Harder bristles are used for heavy duty cleaning and softer bristles for use on more sensitive surfaces. The base 111 of the first brush head 110 may be sized according to the use of the double action push broom 10. For larger cleaning surface areas, the first brush head 110 may be made larger, and for cleaning smaller areas made smaller.

The base 111 has a perimeter edge defined by a first edge 180, second edge 182, third edge 184, and fourth edge 186. In the preferred embodiment the base is substantially rectangular. The base 111 is further formed with a mounting hole 114 adjacent the fourth edge 186 of the base 111. The first brush head 110 is rotatably connected to the brush head base 130 at mounting hole 114. The fourth edge 186 of the base 111 has a straight section 188 followed by a curved section 189. The mounting hole 114 provides a mounting point in which a fastener 133 may be rigidly attached to the first brush head 110. The first brush head 110 is mounted to the brush head base 130 through the use of the fastener 133. A sleeve bearing 132 is inserted into the first brush mounting point 131 of the brush head base and the fastener 133 is inserted through the sleeve bearing 132 and the mounting hole 114 of the base 111 of the first brush head 110. The fastener passes through the mounting hole 114 and subsequently threaded into a corresponding nut 118 and tightened. The sleeve bearing 132 provides a low-friction surface in which the fastener smoothly rotates about with ease, thereby allowing the first brush head 110 to rotate with ease. Alternatively, the sleeve bearing 132 may be placed within the mounting hole 114 of the first brush head 110. It is contemplated that the use of the sleeve bearing 132 is not meant to be limiting and various other types of bearings may be used without departing form the scope and spirit of the invention. Alternatively, the first brush head mounting point 131 may be finished to provide a smooth, low-friction surface removing the need to have a sleeve bearing 132.

The second brush head 120 is substantially similar to the first brush head 110 and includes all of the same structures. The second brush head 120 has a base 121 formed with a mounting hole 124 and a perimeter edge defined by a first edge 190, a second edge 192, a third edge 194, and a fourth edge 196. The fourth edge 196 includes a straight section 198 followed by a curved section 199. Bristles 122 are fixedly attached to the base 121 and extend normal therefrom. The second brush head 120 is attached to the brush head base 130 through the use of a fastener 136 which is inserted through a sleeve bearing 135 which is inserted into the second brush head mounting point 134 and subsequently through the base 121 of the second brush head 120 at the mounting hole 124. A nut 128 is threaded over the fastener 136 and tightened to hold the second brush head to the fastener 136.

The first and second brush head 110 and 120, respectively, are rotatably attached to the brush head base 130 at a predetermined position which allows the bristles 112 and 122 to overlap at the edges. The first and second brush head 110 and 120, respectively, are placed adjacent with the fourth edge 186 and the fourth edge 196 in contact. This ensures that there are no large gaps in which debris may pass through. Further, the positioning of the first brush head 110 relative to the second brush head 120 creates a clearance gap which allows the first brush head 110 and the second brush head 120 to rotate independent from another. However, the fourth edge 186 of the first brush head 110 and the fourth edge 196 of the second brush head 120 controls the maximum brush angle 160 shown in FIG. 1. The maximum brush angle 160 is controlled by the straight sections 188 and 198 of the fourth edge 186 and 196, respectively. The curved sections 189 and 199 allow the first brush head 110 and second brush head 120 to rotate relative to one another. The first brush head 110 and the second brush head 120 rotates until the straight sections 188 and 198 come into contact thereby preventing further rotation. In the preferred embodiment, the maximum brush angle 160 is one-hundred eighty (180) degrees. The curved sections 189 and 199 allow the first brush head 110 and the second brush head 120 to rotate inward, decreasing the brush angle 160.

In the preferred embodiment, a torsion spring 150, having a spring coil 156 terminating at a first moment arm 152 and a second moment arm 154, is rigidly attached to the brush head base 130. The first moment arm 152 is rigidly attached to the first brush head 110 and the second moment arm 154 is rigidly attached to the second brush head 120. In the preferred embodiment, the spring 150 is a helical torsion spring. However, as discussed above the use of the torsion spring is not meant to be limiting. The helical torsion spring 150 is a metal rod or wire coiled in the shape of a helix that is subjected to twisting about the axis of the coil by sideways forces applied to its ends, twisting the coil tighter. The spring subsequently stores mechanical energy when it is twisted. When the coil is twisted, it exerts a force in the opposite direction proportional to the amount it is twisted.

The torsion spring 150 in the preferred embodiment is constructed with a predetermined resting angle between the first moment arm 152 and the second moment arm 154 and a predetermined spring constant. For heavy duty cleaning applications, a larger spring constant may be desirable whereas for light cleaning a smaller spring constant may be desirable. Similarly, for smaller sweeping motions a smaller resting angle between the first moment arm 152 and the second moment arm 154 may be desirable and for a larger sweeping motion the resting angle may be smaller. However, it is contemplated that the spring constant and resting angle is different for different applications and may be varied without departing from the scope and spirit of the invention.

The torsion spring 150 is rigidly attached to the brush head base 130 through the use of a retainer 158 and retainer fastener 159. The retainer 158 is placed over a coil of the spring coil 156 and is fastened in place by the fastener 159 which is threaded into the spring mounting point 138 formed on the brush head base 130. This ensures that the torsion spring 150 is rigidly in place. In the preferred embodiment, the torsion spring 150 is fixedly attached to the brush head base 130 where the axis of the spring is substantially at the center of the brush head base 130. The torsion spring 150 is positioned to allow the first moment arm 152 to attach to the first brush head 110 and the second moment arm 154 to attach to the second brush head 120 at a substantially similar distance from the axis of rotation of each brush. This allows the force of the torsion spring 150 to be equally distributed between the first brush head 110 and the second brush head 120.

A handle 170 having a threaded end 172 corresponding with the threads of the threaded bore 142 is attached to the dynamic double action dual brush head 100. The handle 170 is threadably received by the threaded bore 142 of the handle mount 140. As a result, the handle 170 extends from the dynamic double action dual brush head 100 at a twenty-two

(22) degree angle. The twenty-two (22) degree angle allows a person to grip the handle and apply adequate force to the attached dynamic double action dual brush head 100 to push and sweep. It is contemplated, however, that a twenty-two (22) degree angle is not meant to be limiting. Various other angles may be contemplated and used depending on the user's needs without departing for scope and spirit of the invention.

Figure 3:
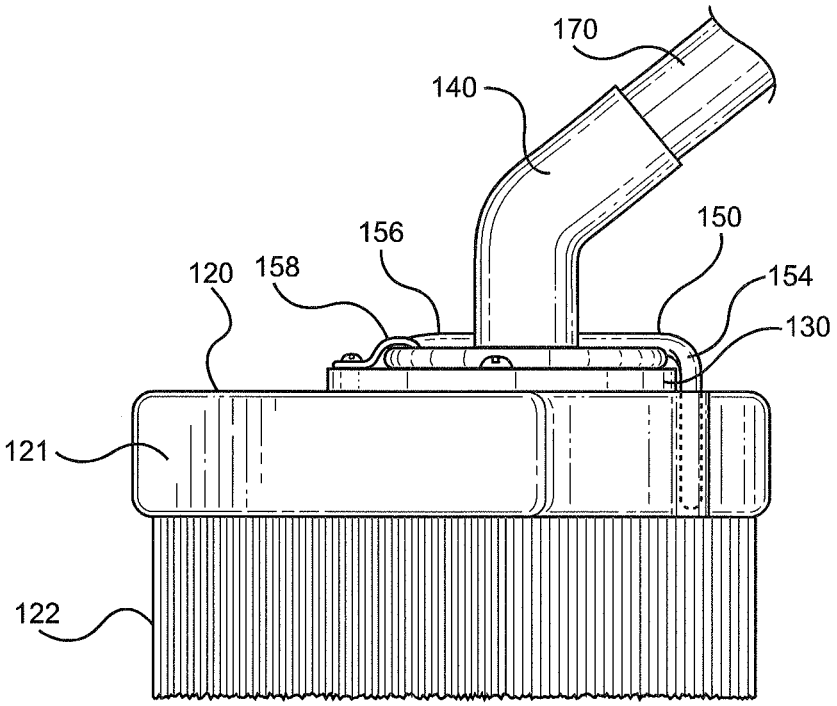
FIG. 3 is a side view of the dynamic double action dual brush head.
Figure 4:
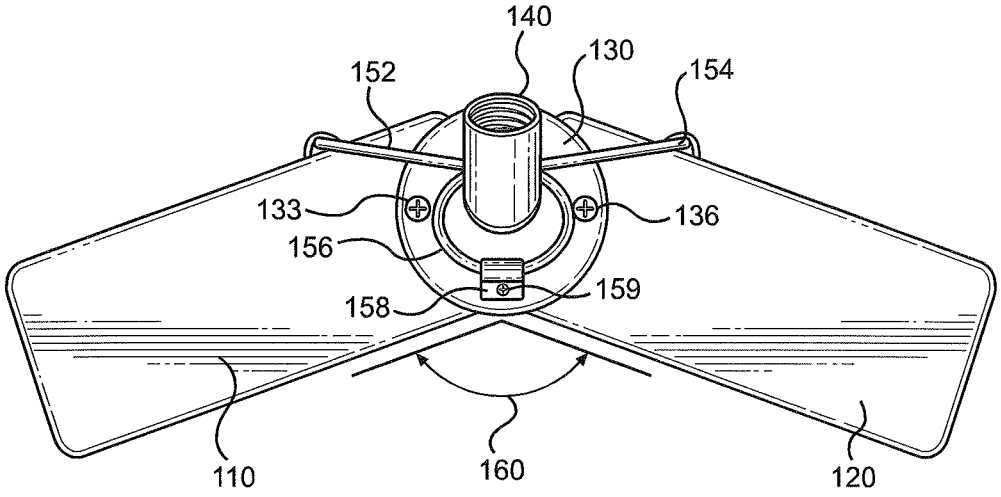
FIG. 4 is a top view of the dynamic double action dual brush head.
Figure 6:
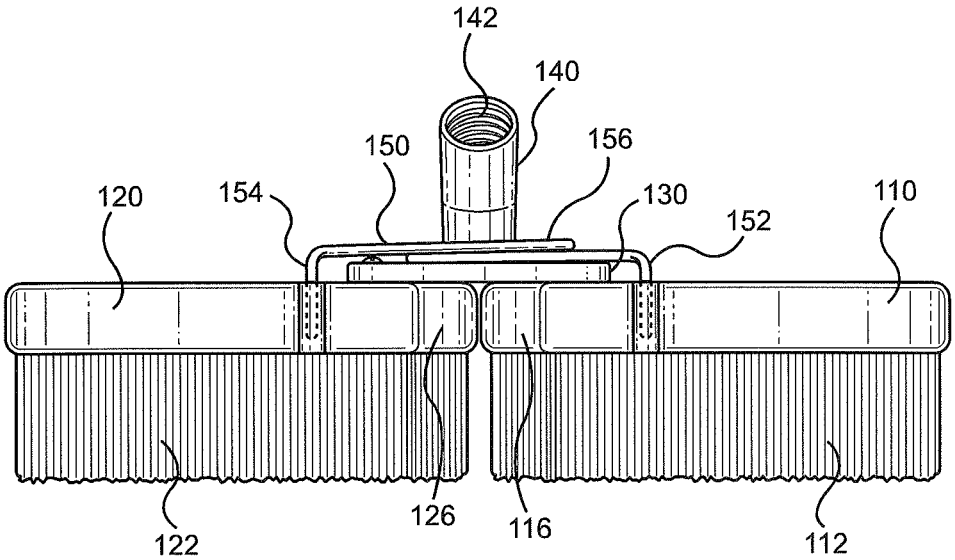
FIG. 6 is a back view of the dynamic double action dual brush head.

Referring now to FIG. 3, a side view of the dynamic double action dual brush head 100 is shown. The second moment arm 154 of the tension spring 150 is rigidly attached to the second brush head 120. The second moment arm 154 is attached to the second brush head 120 through the use of an adhesive. However, it is contemplated that various other methods of attachment may be used to attach the second moment arm 154 to the second brush head 120 such as a fastener, or a receiver formed in the second brush head 120 may be used to retain the second moment arm 154. As shown in FIG. 4 and FIG. 6, the first moment arm 152 is attached to the first brush head 110 using a similar method and structure. Referring back to FIG. 3, the handle mount 140 bends at a twenty-two (22) degree angle from the surface of the brush head base 130. The handle 170 is threadably received by the handle mount 140 and also positioned at a twenty-two (22) degree angle form the surface of the brush head base 130. This allows a user to grip the handle and apply adequate force to push the broom and sweep the floor.

Referring now to FIG. 4, a top view of the brush head is shown. As shown, the spring coil 156 of the torsion spring 150 is rigidly attached to the brush head base 130 with the first moment arm 152 attached to the first brush head 110 and the second moment arm 154 attached to the second brush head 120. At rest, the brush angle 160 is equal to the rest angle of the torsion spring 150.

Figure 5:
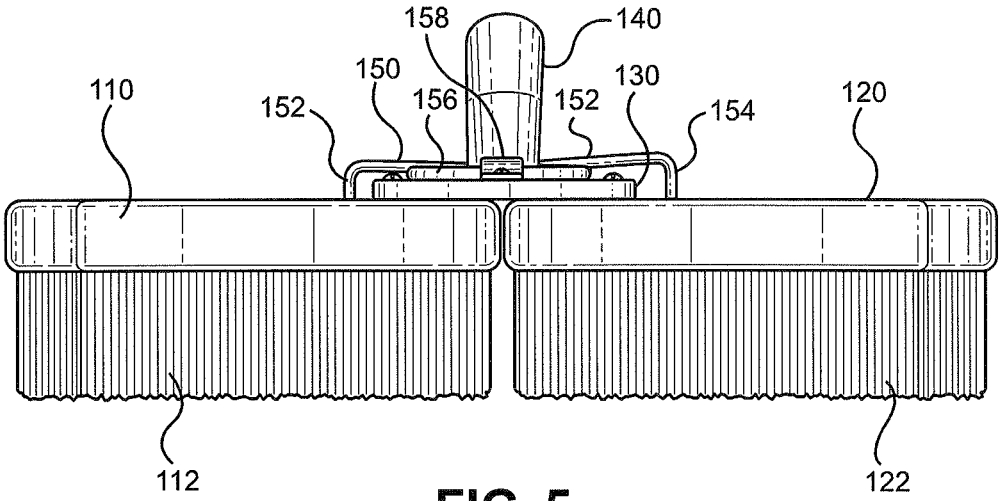
FIG. 5 is a front view of the dynamic double action dual brush head.

Referring now to FIG. 5, a front view of the dynamic double action dual brush head 100 is shown. The dynamic double action dual brush head 100 includes a first brush head 110 and a second brush head 120. The bristles 112 of the first brush head 110 and the bristles 122 of the second brush head 120 intertwine together to create a tight brush surface for the dynamic double action dual brush head 100. This ensures no large gaps are present in the brush surface in which debris may slip past.

Referring now to FIG. 6, a back view of the dynamic dual brush head 100 is shown. As shown the handle mount 140 has a threaded bore 142 corresponding with the threaded end 172 of the handle 170. This allows the handle 170 to thread into and out of the threaded bore 142 to allow the replacement of either the handle 170 or the dynamic double action dual brush head 100 in situations where either part is damaged.

Figure 7:
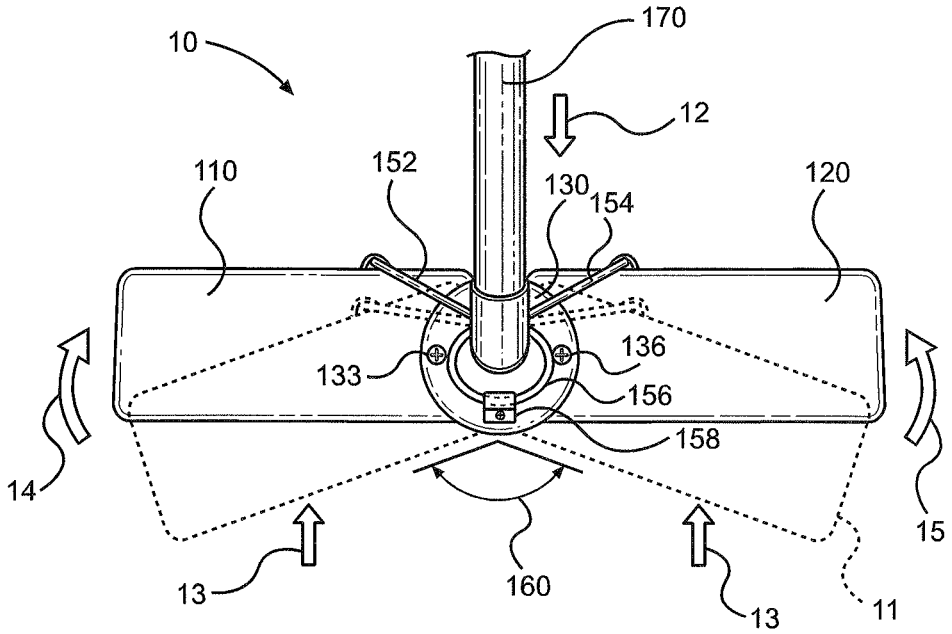
FIG. 7 is top view of the dynamic double action dual brush head broom in use with the dynamic double action dual brush head rotated to its maximum brush angle.

Referring now to FIG. 7, the double action push broom 10 is shown pushed in a forward direction 12 by a user. Before a user begins pushing the double action push broom 10, the double action push broom 10 is at rest and the brush angle 160 between the first brush head 110 and second brush head 120 is at its original angle at rest position 11. As the user begins pushing the double action push broom 10, the force exerted by the user is transferred from the broom handle 170 to the bristles 112 and 122 of the first and second brush head 110 and 120, respectively.

Due to the twenty-two (22) degree angle of the broom handle 170, the force has a vertical and horizontal component. The horizontal component of the force pushes the broom towards direction 12 while the vertical component creates friction between the bristles 112 and 122 of the first and second brush 110 and 120 and the surface being swept. The friction counteracts the horizontal component of the force by producing an opposite force 13. However, as the user applies more force, the friction is eventually overcome and the broom 10 begins to advance in direction 12. The counteracting force 13 acts on the first brush head 110 and the second brush head 120 thereby rotating the first brush head 110 and the second brush head 120 along their respective axis of rotation.

The counteracting force 13 rotates the first brush head 110 in direction 14 and second brush head 120 in direction 15 along its axis of rotation. Provided an adequate amount of counteracting force 13 is present, the first brush head 110 and second brush head 120 may rotate until the maximum brush angle 160 is achieved. In the preferred embodiment, the maximum brush angle 160 is one-hundred eighty (180) degrees. At its maximum brush angle 160, the straight sections 188 and 198 of the first brush head 110 and second brush head 120 come into contact to prevent further rotation, providing a straight brush with the longest available width. As discussed above, the maximum brush angle 160 may be varied to meet the requirements of the broom 10.

Figure 8:
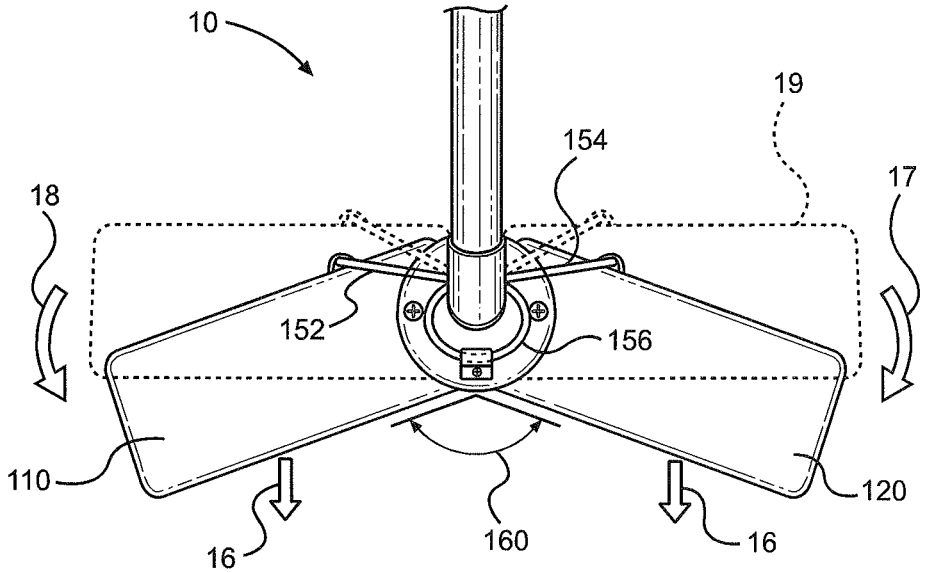
FIG. 8 is a top view of the dynamic double action dual brush head broom after a complete sweep stroke with the dynamic dual brush head reverting back to its rest angle.

As shown in FIG. 8, once the user stops moving the broom 10 in direction 12 and the force stops, the mechanical potential energy of the torsion spring 150 is released and transferred back into the dynamic double action dual brush head 100, providing force 16 and rotating the first brush head 110 in direction 18 and second brush head 120 in direction 17 along its respective axis of rotation to the initial rest angle of the dynamic double action dual brush head 100. The conversion of force from potential to kinetic energy results in the rotation of the dynamic double action dual brush head 100 from its prior position 19 to its original angle at position 11, creating the additional sweeping motion which dramatically improves the effectiveness of the double action push broom 10 over traditional push brooms.

The additional dynamic movement of the double action push broom 10 provides an additional sweeping motion which traditional push brooms are not capable of performing. Further, the dynamic motion of the dynamic dual brush head 100 sweeps the dirt towards the center of the broom allowing easier collection of dirt and dust. Additionally, with traditional push brooms, dirt tends to be collected towards the ends of the broom. With the dynamic motion of the dynamic dual brush head 100, the dirt at the ends swept up and pushed towards the center. Further, the force exerted by the spring releases any trapped debris from the bristles 112 and 122, providing a cleaner push broom for the next sweep.

Figure 9:
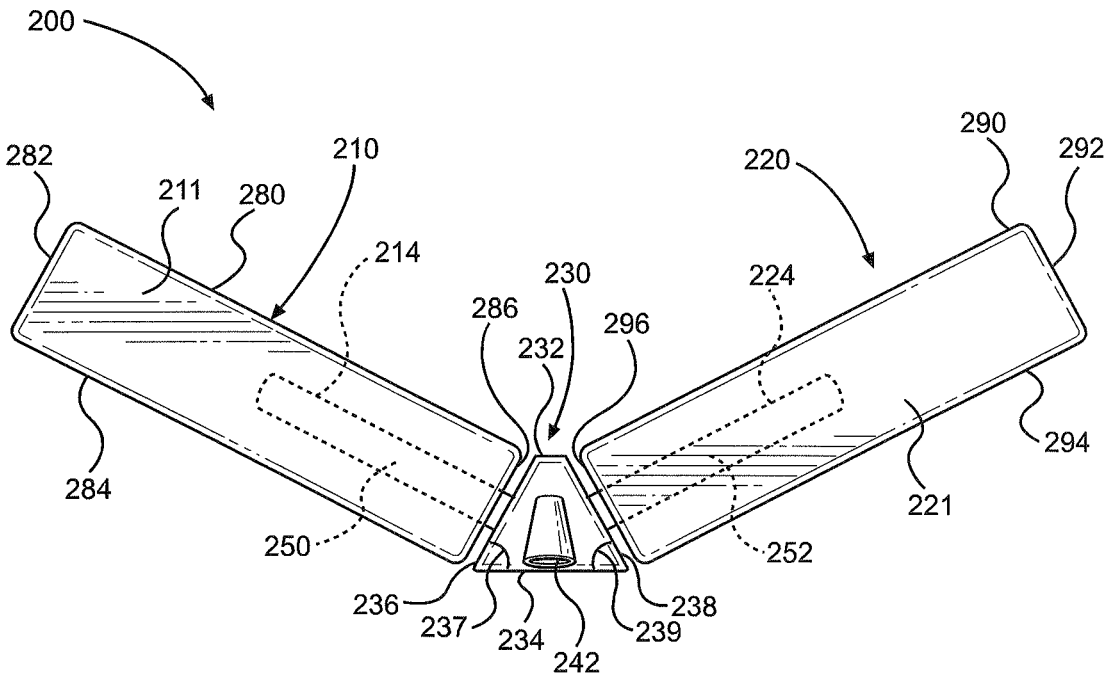
FIG. 9 is a top view of an alternative embodiment of the dynamic double action dual brush head.

Referring now to FIG. 9, an alternative embodiment of the dynamic double action dual brush head of the present invention is shown and generally designated 200. The dynamic double action dual brush head 200 includes two separate brush heads, a first brush head 210 and a second brush head 220 rotatably connected to a brush head base 230.

In the preferred embodiment of the dynamic double action dual brush head 200, the brush head base 230 is a base having the shape of a trapezoid with a top edge 232, a bottom edge 234, a first side edge 236, and a second side edge 238. The top edge 232 and the bottom edge 234 are parallel. The first edge 236 is formed at an angle 237 and the second edge 238 is formed at an angle 239 with the same measure, thereby forming an isosceles trapezoid. At the center of the brush head base 230, handle mount 240 is fixedly attached to the brush head base 230. Formed on the base 230, opposite the handle mount are bristles. The handle mount 240 protrudes normal from the surface of the brush head base 230 and subsequently angles at a twenty-two (22)

degree angle before terminating. The end of the handle mount 240 opposite the fixed end is formed with a threaded bore 242.

Formed perpendicular on the side of the first side edge 236 is a first arm 250 and formed perpendicular on the side of the second side edge 238 is a second arm 252. The first arm 250 and the second arm 252 are made of an elastic material with a high stiffness that would allow for slight deformation while being able to return to its original shape. The type of elastic material used may be rubbers, polyethylene, PTFE, HDPE, polypropylene, PET, certain metals, or any other material having similar physical characteristics and properties. By using the elastic material with a high stiffness, the first arm 250 and the second arm 252 may deflect under a certain amount of force and return to its original shape once that force is removed. The first arm 250 and the second arm 252 are the mechanical energy storage devices. By attaching a first brush head 210 to the first arm 250 and second brush head 220 to the second arm 252, the first brush head 210 and the second brush head 220 is able to provide the extra sweeping motion as described above.

The first brush head 210 includes a base 211 with bristles fixedly attached and extending normal therefrom. The base 211 has a perimeter edge defined by a first edge 280, second edge 282, third edge 284, and fourth edge 286. In the preferred embodiment the base 211 is substantially rectangular. The base 211 is further formed with a mounting hole 214 adjacent the fourth edge 286 and extending into the base 211. The first arm 250 is mounted to the mounting hole 214 where the first arm 250 provides the pivot point for the first brush head 210.

The second brush head 220 is substantially similar to the first brush head 210 and includes all of the same structures. The second brush head 220 includes a base 221 with bristles fixedly attached and extending normal therefrom. The base 221 has a perimeter edge defined by a first edge 290, second edge 292, third edge 294, and fourth edge 296. In the preferred embodiment the base 221 is substantially rectangular. The base 221 is further formed with a mounting hole 224 adjacent the fourth edge 296 and extending into the base 221. The second arm 252 is mounted to the mounting hole 224 where the second arm 252 provides the pivot point for the second brush head 220.

The first and second brush head 210 and 220, respectively, are pivotably attached to the brush head base 230 at a predetermined position which allows the bristles on the first brush head 210 and the bristles on the second brush head 220 to overlap the bristles on the brush head base 230 at the edges. The first and second brush head 210 and 220, respectively, are placed adjacent with the base 230 where the fourth edge 286 contacts the first side edge 236 and the fourth edge 296 is in contact with the second side edge 238. This ensures that there are no large gaps in which debris may pass through. Further, the positioning of the first brush head 210 relative to the second brush head 220 allows the first brush head 210 and the second brush head 220 to pivot independent from another.

Figure 10:
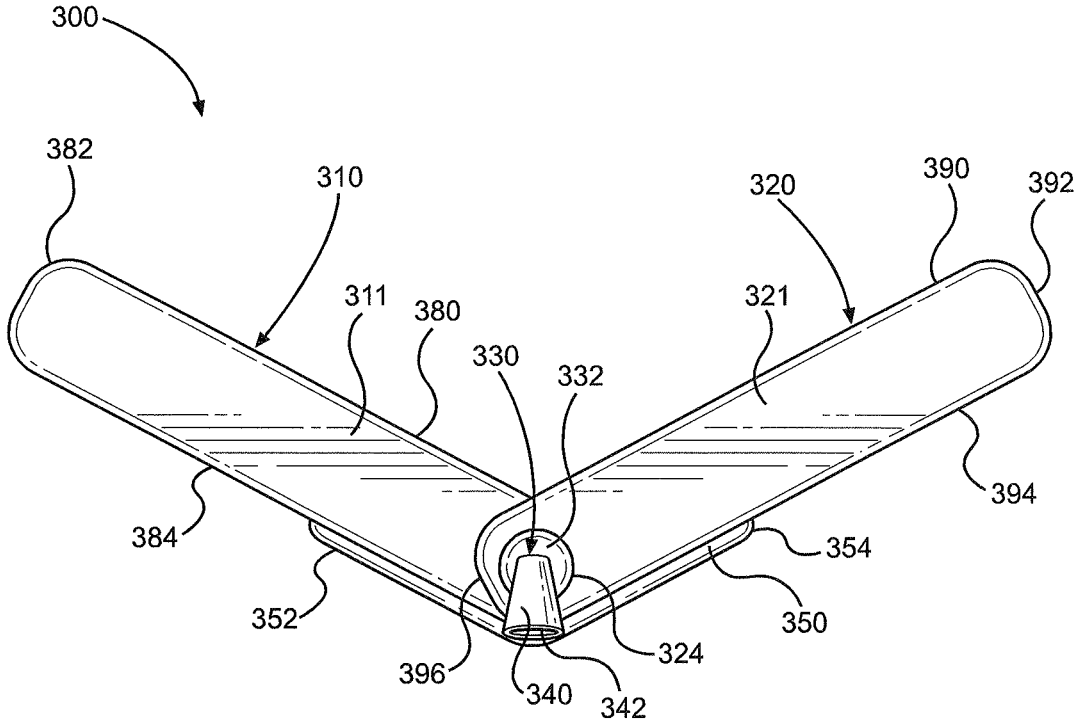
FIG. 10 is a top view of an alternative embodiment of the dynamic double action dual brush head.

Referring now to FIG. 10, an alternative embodiment of the dynamic dual action double brush head of the present invention is shown and generally designated 300. The dynamic double action dual brush head 300 includes two separate brush heads, a first brush head 310 and a second brush head 320 rotatably connected to a brush head base 330.

In the preferred embodiment of the dynamic double action dual brush head 300, the brush head base 330 is a base having the shape of a circle with an upper mounting surface 332 and a lower mounting surface. The upper mounting surface 332 and the lower mounting surface are formed adjacent and may pivot independent from one another. The upper mounting surface 332 and the lower mounting surface have a minimum and maximum rotation angle. At the center of the brush head base 330, handle mount 340 is fixedly attached to the brush head base 330. The handle mount 340 protrudes normal from the surface of the brush head base 330 and subsequently angles at a twenty-two (22) degree angle before terminating. The end of the handle mount 340 opposite the fixed end is formed with a threaded bore 342.

The first brush head 310 includes a base 311 with bristles fixedly attached and extending normal therefrom. The base 311 has a perimeter edge defined by a first edge 380, second edge 382, third edge 384, and fourth edge. In the preferred embodiment the base 311 is substantially rectangular, with the fourth edge slightly curved. The base 311 is further formed with a mounting hole adjacent the fourth edge and extending through the base 311. The lower mounting surface of the brush head base 330 is mounted to the mounting hole where the lower mounting surface provides the pivot point for the first brush head 310.

The second brush head 320 is substantially similar to the first brush head 310 and includes all of the same structures. The second brush head 320 includes a base 321 with bristles fixedly attached and extending normal therefrom. The base 321 has a perimeter edge defined by a first edge 390, second edge 392, third edge 394, and fourth edge 396. In the preferred embodiment the base 321 is substantially rectangular, with the fourth edge 396 slightly curved. The base 321 is further formed with a mounting hole 324 adjacent the fourth edge 396 and extending through the base 321. The upper mounting surface 332 of the brush head base 330 is mounted to the mounting hole 324 where the upper mounting surface 332 provides the pivot point for the second brush head 320.

The first and second brush head 310 and 320, respectively, are pivotably attached to the brush head base 330 at a predetermined position which allows the bristles on the first brush head 310 and the bristles on the second brush head 320 to overlap. Due to the first brush head 310 attached to the lower mounting surface of the brush head base 330, the second brush head 320 overlaps the first brush head 310. To provide a smooth surface for which the second brush head 320 may pivot relative to the first brush head 310, the section of the base 321 which overlaps the first brush head 310 is devoid of bristles. Alternatively, if the second brush head 320 was mounted to the lower mounting surface, then sections of the first brush head 310 would be devoid of bristles. This further ensures that there are no large gaps in which debris may pass through. Further, the positioning of the first brush head 310 relative to the second brush head 320 allows the first brush head 310 and the second brush head 320 to pivot independent from another.

Attached to the first brush head 310 and the second brush head 320 is a mechanical energy storage device 350 having a first arm 352 attached to the first brush head 310 and a second arm 354 attached to the second brush head 320. In a preferred embodiment, the mechanical energy storage device 350 is made of an elastic material with a high stiffness that would allow for slight deformation while being able to return to its original shape. The type of elastic material used may be rubbers, polyethylene, PTFE, HDPE, polypropylene, PET, certain metals, or any other material having similar physical characteristics and properties. By using the elastic material with a high stiffness, the first arm 352 and the second arm 354 may deflect under a certain amount of force and return to its original shape once that force is removed. By attaching the first brush head 310 to the first arm 352 and second brush head 320 to the second arm 354, the first brush head 310 and the second brush head 320 are able to provide the extra sweeping motion as described above.

Figure 11:
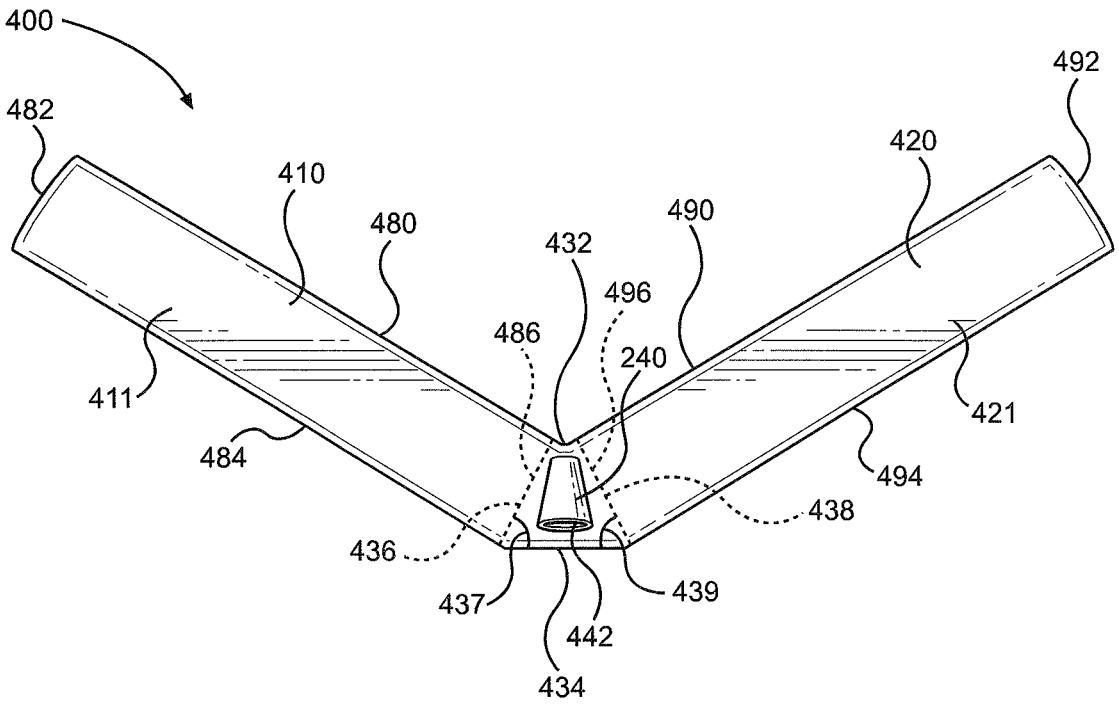
FIG. 11 is a top view of an alternative embodiment of a dynamic double action brush head.

Referring now to FIG. 11, a dynamic double action brush head of the present invention is shown and generally designated 400. The dynamic double action brush head 400 includes a base 430 having a first arm 410 and a second arm 420 integrally formed with the base 430.

In the preferred embodiment of the dynamic double action brush head 400, the base 430 has a trapezoid shape with an exposed top edge 432 and bottom edge 434. The first side edge 436 and the second side edge 438, designated by dashed lines, have the first arm 410 and second arm 420 integrally formed and protruding from the first side edge 436 and second side edge 438, respectively. The top edge 432 and the bottom edge 434 are parallel. The first edge 436 is formed at an angle 437 and the second edge 438 is formed at an angle 439 with the same measure, thereby forming an isosceles trapezoid. At the center of the base 430, handle mount 440 with a threaded bore 442 is formed into the base 430.

The first arm 410 includes a base 411 with bristles fixedly attached and extending normal therefrom. The base 411 has a perimeter edge defined by a first edge 480, second edge 482, third edge 484, and fourth edge 486 integrally formed into the first side edge 436 of the base 430. In the preferred embodiment the base 411 is substantially rectangular. The second arm 420 is substantially similar to the first arm 410 and includes all of the same structures. The second arm 420 includes a base 421 with bristles fixedly attached and extending normal therefrom. The base 421 has a perimeter edge defined by a first edge 490, second edge 492, third edge 494, and fourth edge 496 integrally formed into the second side edge 438 of the base 430. In the preferred embodiment the base 421 is substantially rectangular. Bristles are fixedly attached to and extending normal from the base 430. This ensures that an entire single surface of the dynamic double action brush head 400 is covered with bristles and that there are no large gaps in which debris may pass through.

The base 430, the first arm 410 and the second arm 420 are made of an elastic material with a high stiffness that would allow for slight deformation while being able to return to its original shape. The type of elastic material used may be rubbers, polyethylene, PTFE, HDPE, polypropylene, PET, certain metals, or any other material having similar physical characteristics and properties. By using the elastic material with a high stiffness, the first arm 410 and the second arm 420 may deflect under a certain amount of force and return to its original shape once that force is removed. The material of the base 430, the first arm 410 and the second arm 420 allows the first arm 410 and the second arm 420 to deflect thereby storing mechanical energy. As the force is removed the mechanical energy is released and the first arm 410 and the second arm return to its original orientation, thereby providing the extra sweeping motion.

Figure 12:
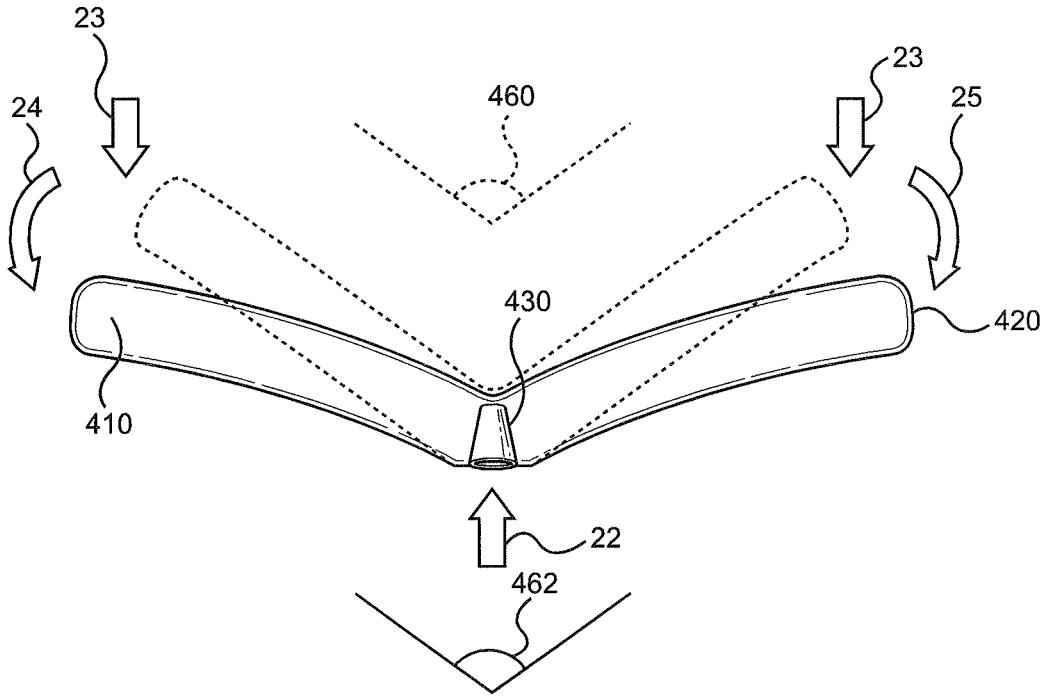
FIG. 12 is a top view of the alternative embodiment of a dynamic double action brush head of FIG. 11 in use with the dynamic double action brush head at its maximum brush angle.

Referring now to FIG. 12, the dynamic dual action brush head 400 is pushed in direction 22. As the dynamic dual action brush head 400 is pushed in direction 22, the bristles and the surface being swept create a friction force 23. As the user applies more force in direction 22, the friction 23 is eventually overcome and the dynamic dual action brush head 400 begins to advance in direction 22. The friction force 23 acts on the first arm 410 and the second arm 420 thereby pivoting the first arm 410 and the second arm 420 along their respective axis.

The friction force 23 rotates the pivots the first arm 410 in direction 24 and the second arm 420 in direction 25. Provided an adequate amount of friction force 23 is present, the first arm 410 and the second are 420 may rotate from a minimum brush angle 460 until a maximum brush angle 462 is achieved. In the preferred embodiment, the maximum brush angle 462 is one-hundred eighty (180) degrees. The maximum brush angle 462 may be varied to meet the requirements of the dynamic dual action brush head 400.

Figure 13:
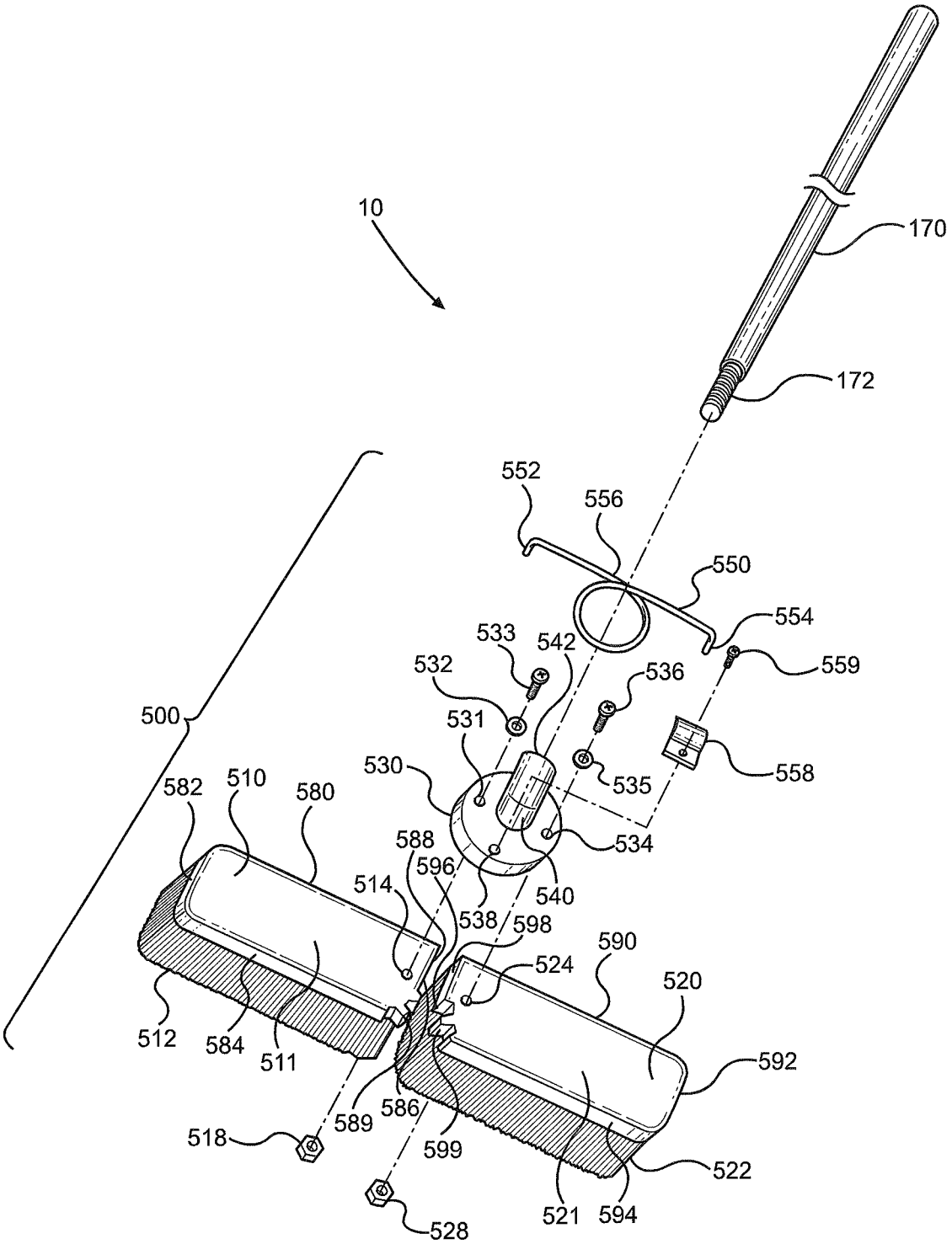
FIG. 13 is an exploded view of an alternative embodiment of the double action push broom with an alternative embodiment of the dynamic double action dual brush head.

Referring now to FIG. 13, an exploded view of an alternative embodiment of the double action push broom 10 of the present invention with an alternative embodiment of the dynamic double action dual brush head 500 is shown. The dynamic double action dual brush head 500 includes two separate brush heads, a first brush head 510 and a second brush head 520 rotatably connected to a brush head base 530.

In the alternative embodiment, the brush head base 530 is flat metal plate in the shape of a circle. It is contemplated that the shape of the brush head base 530 is not limited to the shape of a circle, and that any shape may be utilized. The brush head base 530 is formed with a plurality of attachment points, a first brush head mounting point 531, a second brush head mounting point 534, and a spring mounting point 538. The first brush head mounting point 531 and second brush head mounting point 534 are collinear, with the spring mounting point 538 located on a line perpendicular from each of the brush mounting points. At the center of the brush head base 530, handle mount 540 is fixedly attached to the brush head base 530. The handle mount 540 protrudes normal from the surface of the brush head base 530 and subsequently angles at a twenty-two (22) degree angle before terminating. The end of the handle mount 540 opposite the fixed end is formed with a threaded bore 542 corresponding with the threaded end 172 of the handle 170.

The first brush head 510 includes a base 511 with bristles 512 fixedly attached and extending normal therefrom. The bristles 512 are made of a firm, flexible and durable material such as polyethylene terephthalate (PET), polypropylene, or any other material having similar physical characteristics and properties. The physical characteristics and properties of the bristles 512 may be modified to accommodate different surfaces and uses. Harder bristles are used for heavy duty cleaning and softer bristles for use on more sensitive surfaces. The base 511 of the first brush head 510 may be sized according to the use of the double action push broom 10. For larger cleaning surface areas, the first brush head 510 may be made larger, and for cleaning smaller areas made smaller.

The base 511 has a perimeter edge defined by a first edge 580, second edge 582, third edge 584, and fourth edge 586. The fourth edge 586 of the base 511 has a straight section 588 followed by a gear teeth section 589. The base 511 is further formed with a mounting hole 514 adjacent the fourth edge 586 of the base 511. The first brush head 510 is rotatably connected to the brush head base 530 at mounting hole 514. The mounting hole 514 provides a mounting point in which a fastener 533 may be rigidly attached to the first brush head 510. The first brush head 510 is mounted to the brush head base 530 through the use of the fastener 533. A sleeve bearing 532 is inserted into the first brush mounting point 531 of the brush head base 530 and the fastener 533 is inserted through the sleeve bearing 532 and the mounting hole 514 of the base 511 of the first brush head 510. The fastener passes through the mounting hole 514 and subsequently threaded into a corresponding nut 518 and tightened. The sleeve bearing 532 provides a low-friction surface in which the fastener smoothly rotates about with ease, thereby allowing the first brush head 510 to rotate with ease. Alternatively, the sleeve bearing 532 may be placed within the mounting hole 514 of the first brush head 510. It is contemplated that the use of the sleeve bearing 532 is not meant to be limiting and various other types of bearings may be used without departing form the scope and spirit of the invention. Alternatively, the first brush head mounting point 531 and the mounting hole 514 may be finished to provide a smooth, low-friction surface removing the need to have a sleeve bearing 532.

The second brush head 520 is substantially similar to the first brush head 510 and includes all of the same structures. The second brush head 520 has a base 521 formed with a mounting hole 524 and a perimeter edge defined by a first edge 590, a second edge 592, a third edge 594, and a fourth edge 596. The fourth edge 596 includes a straight section 598 followed by a gear teeth section 599, which corresponds to gear teeth section 589 of the first brush head 510 allowing the both gear teeth sections, 589 and 599, to mesh. Bristles 522 are fixedly attached to the base 521 and extend normal therefrom. The second brush head 520 is attached to the brush head base 530 through the use of a fastener 536 which is inserted through a sleeve bearing 535 which is inserted into the second brush head mounting point 534 and subsequently through the base 521 of the second brush head 520 at the mounting hole 524. A nut 528 is threaded over the fastener 536 and tightened to hold the second brush head 520 to the fastener 536.

The first and second brush head 510 and 520, respectively, are rotatably attached to the brush head base 530 at a predetermined position to allow the gears to mesh and the brush heads to rotate. The first and second brush head 510 and 520, respectively, are placed adjacent with the fourth edge 586 and the fourth edge 596 in contact. Further, the positioning of the first brush head 510 relative to the second brush head 520 enables gear teeth section 589 and gear teeth section 599 to engage and mesh to prevent the first brush head 510 and the second brush head 520 to independently rotate from another. The straight sections 588 and 598 of the fourth edge 586 and 596, respectively, prevents the first brush head 510 and second brush head 520 from further rotation creating a maximum brush angle 560 of 180 degrees. The gear teeth sections 589 and 599 allow the first brush head 510 and second brush head 520 to rotate about the first brush mounting point 531 and the second brush mounting point 534, respectively, while maintaining the exact degree of rotation between the first brush head 510 and second brush head 520. The first brush head 510 and the second brush head 520 rotates until the straight sections 588 and 598 come into contact thereby preventing further rotation. The gear teeth sections 589 and 599 ensures the first brush head 510 and the second brush head 520 to rotate inward at equal angular velocities, decreasing the brush angle 560.

In the alternative embodiment, a torsion spring 550, having a spring coil 556 terminating at a first moment arm 552 and a second moment arm 554, is rigidly attached to the brush head base 530. The first moment arm 552 is rigidly attached to the first brush head 510 and the second moment arm 554 is rigidly attached to the second brush head 520. In the alternative embodiment, the spring 550 is a helical torsion spring. The torsion spring 550 in the preferred embodiment is constructed with a predetermined resting angle between the first moment arm 552 and the second moment arm 554 and a predetermined spring constant. For heavy duty cleaning applications, a larger spring constant may be desirable whereas for light cleaning a smaller spring constant may be desirable. Similarly, for smaller sweeping motions a smaller resting angle between the first moment arm 552 and the second moment arm 554 may be desirable and for a larger sweeping motion the resting angle may be smaller. However, it is contemplated that the spring constant and resting angle is different for different applications and may be varied without departing from the scope and spirit of the invention. As discussed above the use of the torsion spring is not meant to be limiting.

The torsion spring 550 is rigidly attached to the brush head base 530 through the use of a retainer 558 and retainer fastener 559. The retainer 558 is placed over a coil of the spring coil 556 and is fastened in place by the fastener 559 which is threaded into the spring mounting point 538 formed on the brush head base 530. This ensures that the torsion spring 550 is rigidly in place. In the preferred embodiment, the torsion spring 550 is fixedly attached to the brush head base 530 where the axis of the spring is substantially at the center of the brush head base 530. The torsion spring 550 is positioned to allow the first moment arm 552 to attach to the first brush head 510 and the second moment arm 554 to attach to the second brush head 520 at a substantially similar distance from the axis of rotation of each brush. This allows the force of the torsion spring 550 to be equally distributed between the first brush head 510 and the second brush head 520.

Figure 14:
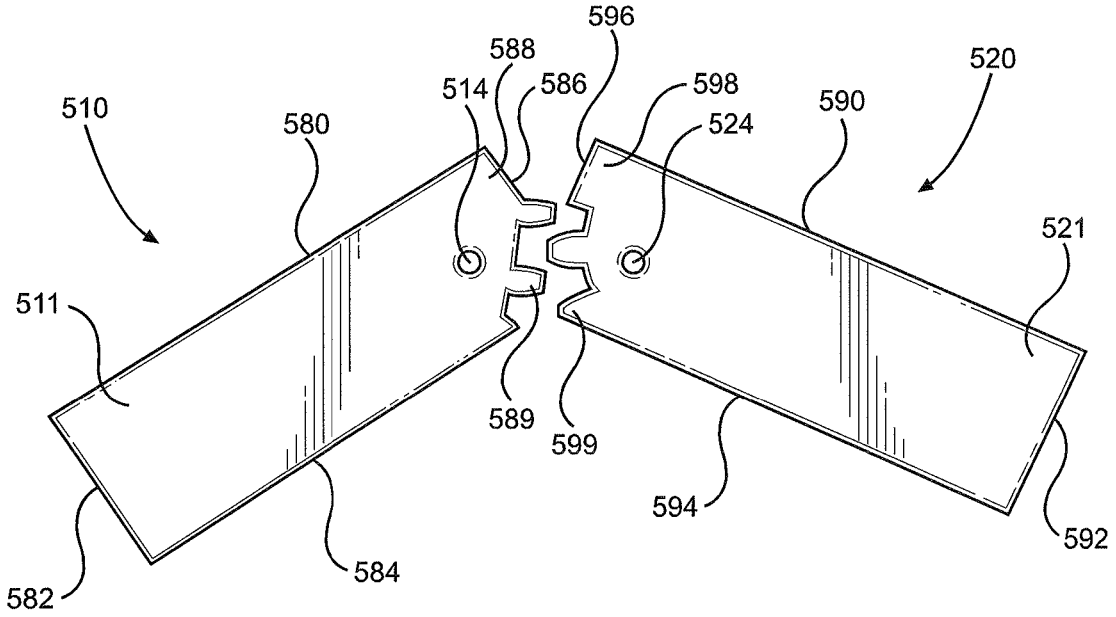
FIG. 14 is a top view of the alternative embodiment of the dynamic double action dual brush head.

Referring now to FIG. 14, the brush head base 530, torsion spring 550, and attachment hardware is not shown on the dynamic double action dual brush head 500, thereby leaving only the first brush head 510 and second brush head 520. A top view of the first brush head 510 and second brush head 520 is shown. The gear teeth section 589 of the first brush head 510 corresponds to the gear teeth section 599 of the second brush head 520 allowing both gear teeth sections to mesh to prevent the first brush head 510 and the second brush head 520 from independent rotation. The gear teeth sections 589 and 599 allow the first brush head 510 and second brush head 520 to rotate about the mounting hole 514 and the mounting hole 524, respectively, while maintaining the exact degree of rotation between the first brush head 510 and second brush head 520. The gear teeth sections 589 and 599 ensure that the first brush head 510 and the second brush head 520 to rotate inward at equal angular velocities. The first brush head 510 and the second brush head 520 rotates until the straight sections 588 and 598 come into contact thereby preventing further rotation.

Figure 15:
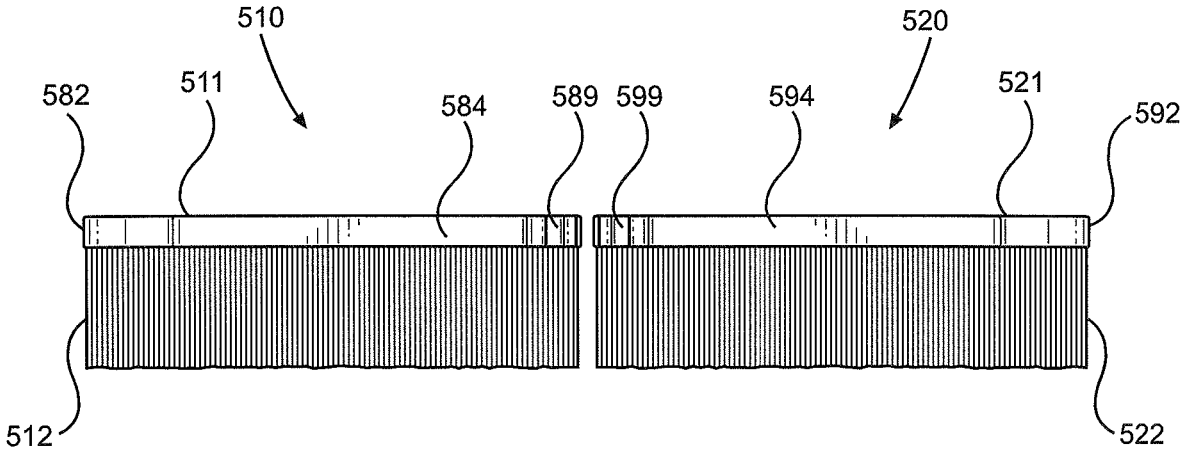
FIG. 15 is a front view of the alternative embodiment of dynamic double actual dual brush head.

Referring now to FIG. 15, the brush head base 530, torsion spring 550, and attachment hardware is not shown on the dynamic double action dual brush head 500, thereby leaving only the first brush head 510 and second brush head 520. A front view of the first brush head 510 and second brush head 520 is shown. The gear teeth section 589 of the first brush head 510 corresponds to the gear teeth section 599 of the second brush head 520 allowing both gear teeth sections to mesh to prevent the first brush head 510 and the second brush head 520 from independent rotation.

Figure 16:
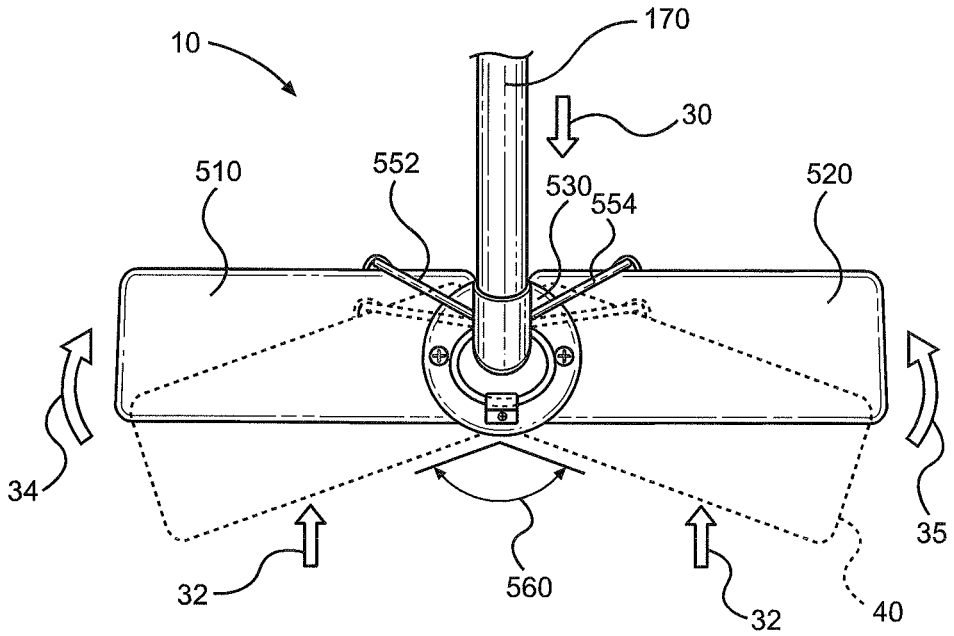
FIG. 16 is top view of the alternative embodiment of the double action push broom in use with the alternative embodiment of the dynamic double action dual brush head rotated to its maximum brush angle.

Referring now to FIG. 16, the double action push broom 10 with the alternative embodiment of the dynamic double action dual brush head 500 is shown pushed in a forward direction 30 by a user. Before a user begins pushing the double action push broom 10, the double action push broom 10 is at rest and the brush angle 560 between the first brush head 510 and second brush head 520 is at its original angle at rest position 40. As the user begins pushing the double action push broom 10, the force exerted by the user is transferred from the broom handle 170 to the bristles 512 and 522 of the first and second brush head 510 and 520, respectively.

Due to the twenty-two (22) degree angle of the broom handle 170, the force has a vertical and horizontal component. The horizontal component of the force pushes the broom towards direction 30 while the vertical component creates friction between the bristles 512 and 522 of the first and second brush 510 and 520 and the surface being swept. The friction counteracts the horizontal component of the force by producing an opposite force 32. However, as the user applies more force, the friction is eventually overcome and the broom 10 begins to advance in direction 30. The counteracting force 32 acts on the first brush head 510 and the second brush head 520 thereby rotating the first brush head 510 and the second brush head 520 along their respective axis of rotation. Since the first brush head 510 and the second brush head 520 are connected together by their respective gear teeth sections 589 and 599, as described above, the first brush head 510 and the second brush head 520 rotate along their respective axis at the same degree and at the same angular velocity.

The counteracting force 32 rotates the first brush head 510 in direction 34 and second brush head 520 in direction 35 along its axis of rotation. Provided an adequate amount of counteracting force 32 is present, the first brush head 510 and second brush head 520 may rotate until the maximum brush angle 560 is achieved. In the preferred embodiment, the maximum brush angle 560 is one-hundred eighty (180) degrees. At its maximum brush angle 560, the straight sections 588 and 598 of the first brush head 510 and second brush head 520, respectively, come into contact to prevent further rotation, providing a straight brush with the longest available width. As discussed above, the maximum brush angle 560 may be varied to meet the requirements of the broom 10.

Figure 17:
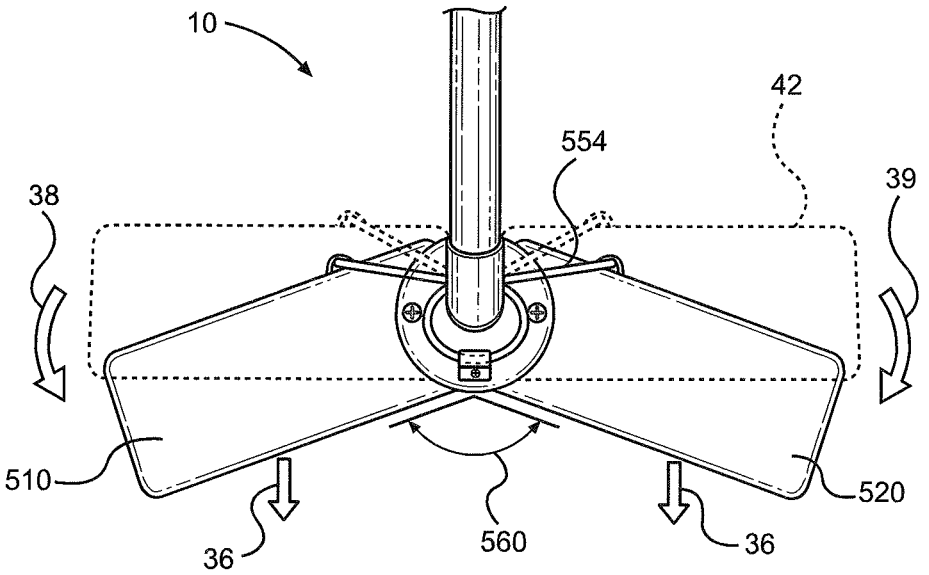
FIG. 17 is a top view of the alternative embodiment of the double action push broom after a complete sweep stroke with the alternative embodiment of the dynamic dual brush head reverting back to its rest angle.

As shown in FIG. 17, once the user stops moving the broom 10 in direction 30 and the force stops, the mechanical potential energy of the torsion spring 550 is released and transferred back into the dynamic double action dual brush head 500, providing force 36 and rotating the first brush head 510 in direction 38 and second brush head 520 in direction 39 along its respective axis of rotation to the initial rest angle of the dynamic double action dual brush head 500. The conversion of force from potential to kinetic energy results in the rotation of the dynamic double action dual brush head 500 from its prior position 42 to its original angle at position 40, creating the additional sweeping motion which dramatically improves the effectiveness of the double action push broom 10 over traditional push brooms.

Figure 18:
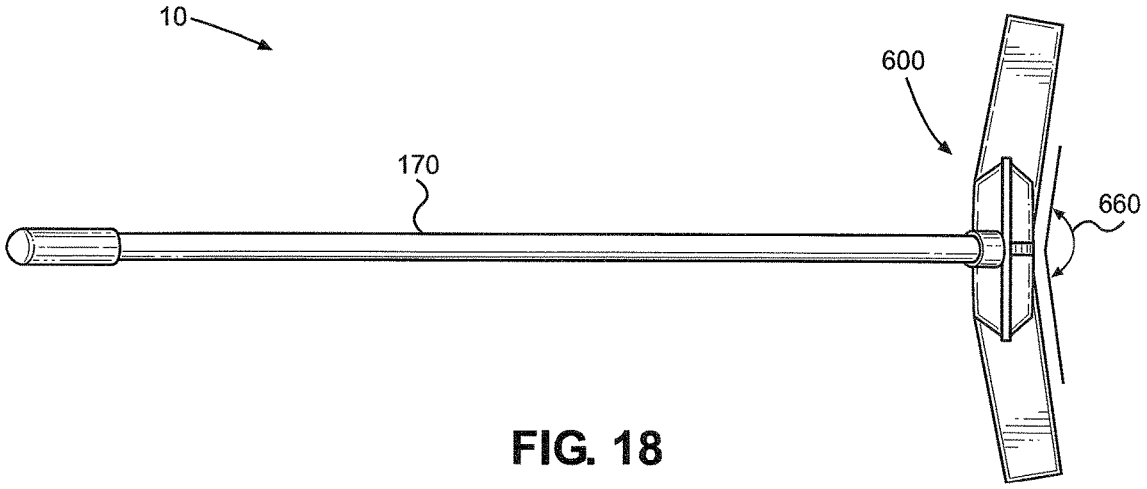
FIG. 18 is a top view of an alternative embodiment of the double action push broom with an alternative embodiment of the dynamic double action dual brush head.
Figure 19:
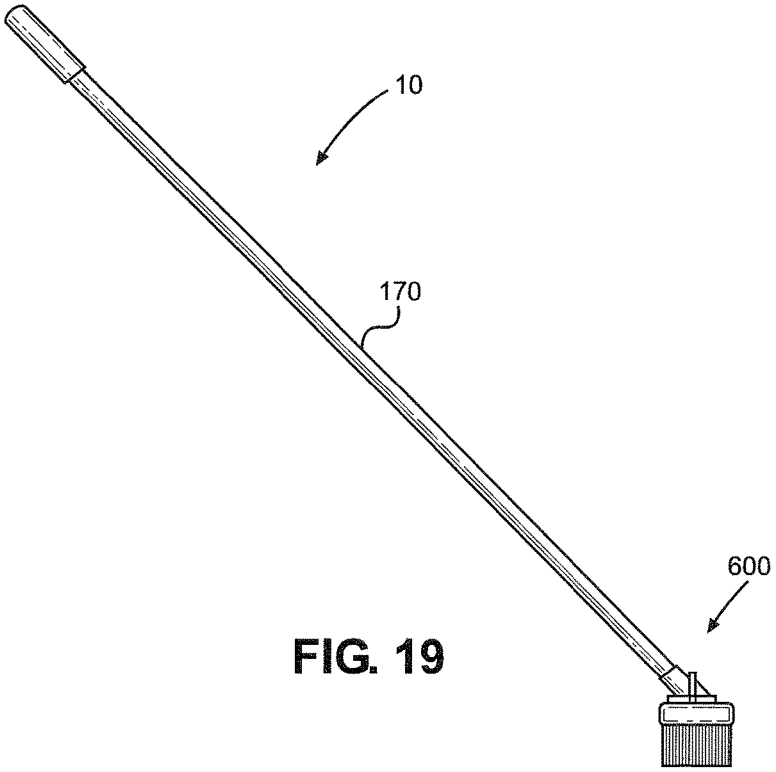
FIG. 19 is a side view of the alternative embodiment of the double action push broom with the alternative embodiment of the dynamic double action dual brush head.
Figure 20:
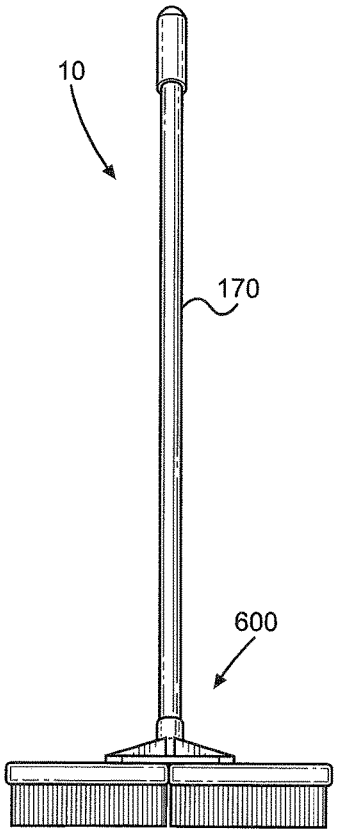
FIG. 20 is a front view of the alternative embodiment of the double action push broom with the alternative embodiment of the dynamic double action dual brush head.

Referring now to FIGS. 18, 19, and 20, an alternative embodiment of the double action push broom 10 of the present invention with an alternative embodiment of the dynamic double action dual brush head 600 is shown. The handle 170 is removably attached to the dynamic double action dual brush head 600. The dynamic double action dual brush head 600 includes a first and second brush head are configured at a brush angle 660. The first and second brush heads are biased into neutral positions and each brush head is adapted to deflect in use upon application of a force and return to the neutral position when the force is removed. The return to the neutral position by the dynamic double action brush head 600 when the force is removed provides an additional sweeping motion.

Figure 21:
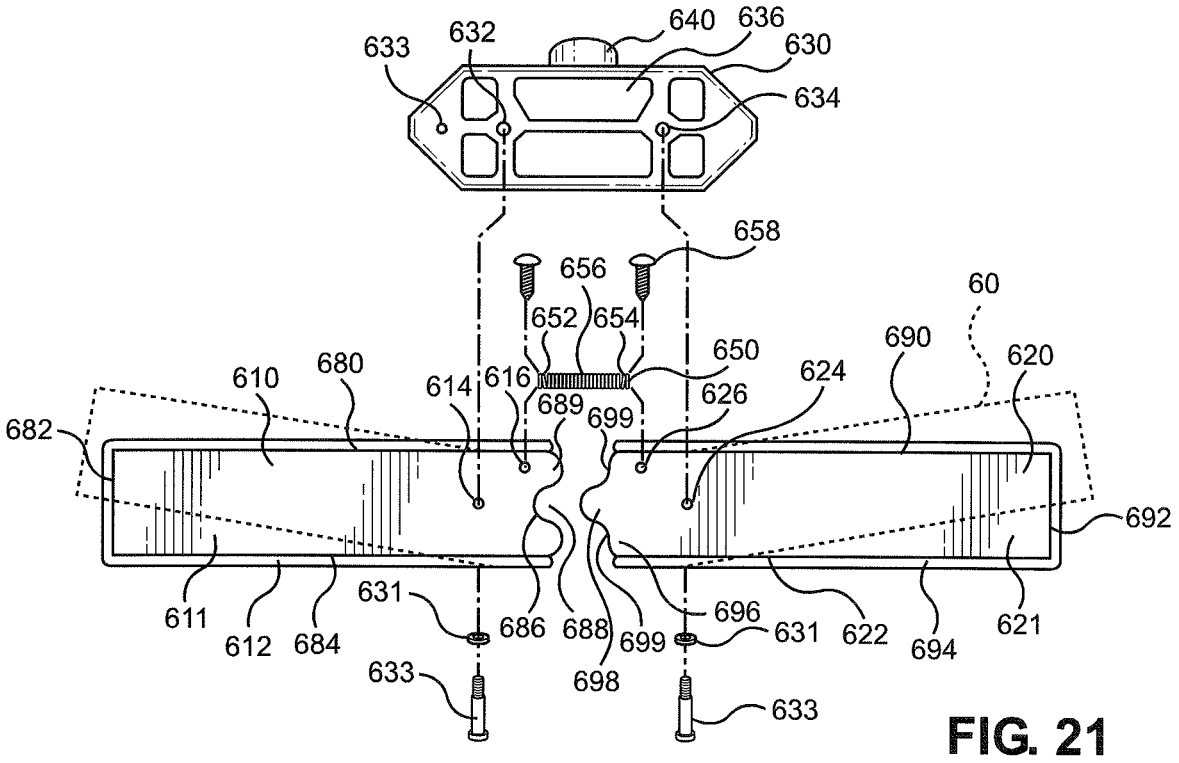
FIG. 21 is an exploded view of the alternative embodiment of the dynamic double action dual brush head.

Referring now to FIG. 21, an exploded view of the alternative embodiment of the dynamic double action dual brush head 600 is shown. The dynamic double action dual brush head 600 includes two separate brush heads, a first brush head 610 and a second brush head 620 rotatably connected to a brush head base 630. As shown, the bottom of the brush head base 630 is depicted in FIG. 21.

In the alternative embodiment, the brush head base 630 is flat plate in a hexagonal shape with a top surface 631 (see FIG. 22) and a bottom surface 633. It is contemplated that the shape of the brush head base 630 is not limited to a particular shape, and that any shape may be utilized. The brush head base 630 is formed with a plurality of attachment points, a first brush head mounting point 632 and a second brush head mounting point 634. The first brush head mounting point 634 and second brush head mounting point 634 are collinear. A plurality of cavities 636 are formed in the bottom surface 633 of the brush head base 630. At the center of the brush head base 630 on the top surface 631, handle mount 640 is fixedly attached to the brush head base 630. The handle mount 640 protrudes normal from the surface of the brush head base 630 and subsequently angles at a twenty-two (22) degree angle before terminating. The end of the handle mount 640 opposite the fixed end is formed with a threaded bore 642 (not shown) corresponding with the threaded end 172 of the handle 170.

The first brush head 610 includes a base 611 with bristles 612 fixedly attached and extending normal therefrom. The base 611 has a perimeter edge defined by a first edge 680, second edge 682, third edge 684, and fourth edge 686. The fourth edge 686 of the base 611 is formed with a socket 688 with shoulders 689 on both sides of the socket 688. The base 611 is further formed with a first brush head mounting hole 614 and a first brush head spring mounting point 616 adjacent the fourth edge 686 of the base 611 with first brush head spring mounting point 616 biased towards the first edge 680. The first brush head 610 is rotatably attached to the brush head base 630 at mounting hole 614. The mounting hole 614 provides a hole in which a fastener 633 may pass through and be rigidly attached to the brush head base 630. The fastener 633 is a shoulder screw, thus a sleeve bearing is not needed. Since the fastener 633 is rigidly attached to the brush head base 630, a washer 631 is used between the fastener 633 and the first brush head 610 to prevent premature wear on the first brush head 610 due to the rotation of the first brush head 610 about the fastener 633.

Figure 22:
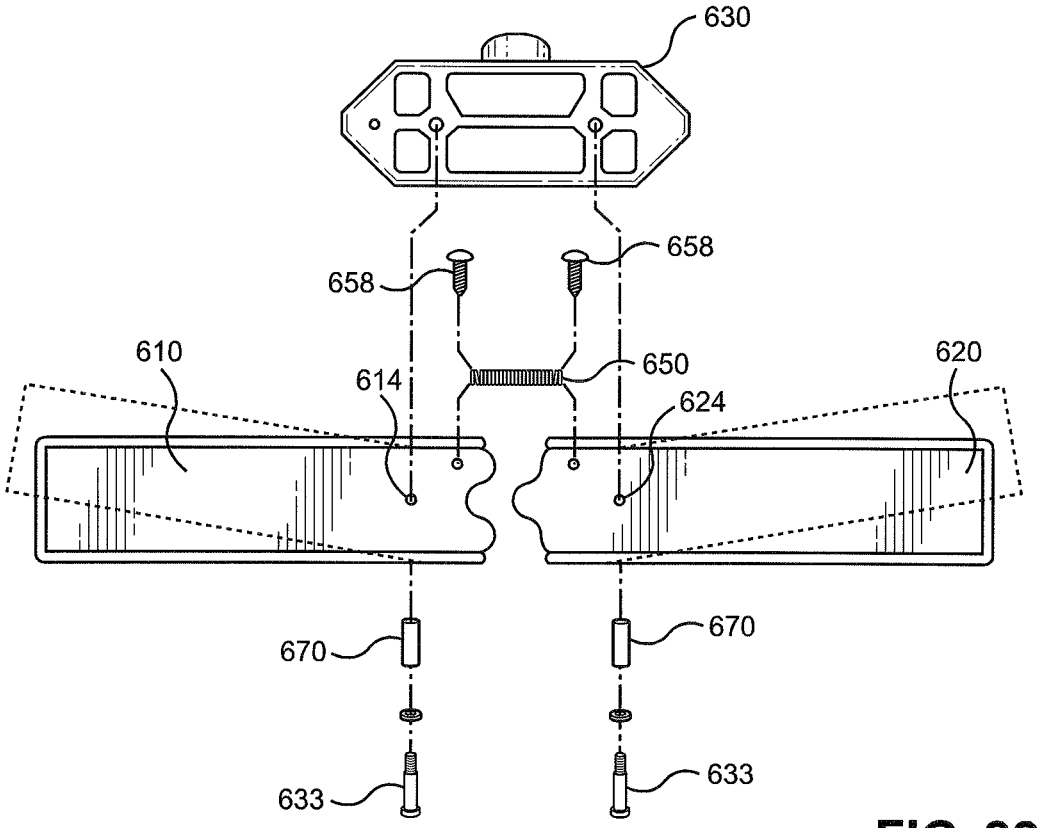
FIG. 22 is an exploded view of the alternative embodiment of the dynamic double action dual brush head with sleeve bearings.

As shown in FIG. 22, it is contemplated that a sleeve or bushing 670 may be incorporated into the bores 614 and 624 of the first brush head 610 and the second brush head 620, respectively. The sleeve or bushing 670 is pressed into the bores 614 and 624 of the first brush head 610 and the second brush head 620, which are sized to receive the sleeve or bushing 670. By having the sleeve or bushing 670 pushed into the first brush head 610 and the second brush head 620 in the corresponding bores 614 and 624, there is no friction between the fasteners 633 and the first brush head 610 and the second brush head 620. Instead, the friction is between the sleeve or bushing 670 and the fastener 633. This prolongs the life of the dynamic double action dual brush head 600.

Figure 23:
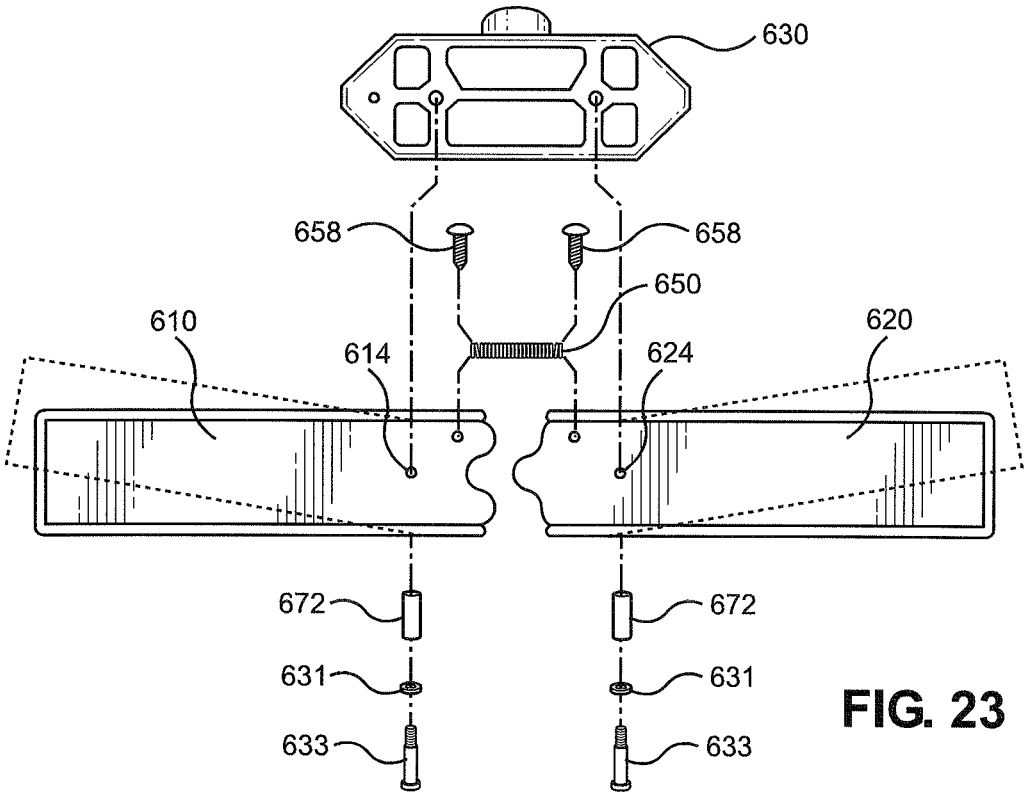
FIG. 23 an exploded view of the alternative embodiment of the dynamic double action dual brush head with roller bearings.

Alternatively, as shown in FIG. 23, roller bearings 672 can be included to further prolong the life of the dynamic double action dual brush head 600. The use of the roller bearings 672 further minimizes the rotational friction between the fastener 633 and the first brush head 610 and the second brush head 620 by focusing all of the rotational friction on the roller bearings 672. The roller bearings 672 are pressed into the bores 614 and 624 of the first brush head 610 and the second brush head 620, which are sized to receive the roller bearings 672. The fasteners 633 are then friction fitted within the roller bearing 672. By having the roller bearing 672 pushed into the corresponding bores 614 and 624, and the fasteners 633 friction fitted within the roller bearings 672, there is no friction between the fasteners 633 and the first brush head 610 and the second brush head 620. Instead, the rotational friction is between the components of the roller bearing 672. This prolongs the life of the dynamic double action dual brush head 600.

Referring back to FIG. 21, the second brush head 620 is substantially similar to the first brush head 610 and includes many of the same structures. The second brush head 620 has a base 621 with a perimeter edge defined by a first edge 690, a second edge 692, a third edge 694, and a fourth edge 696. The base 621 is further formed with a second brush head mounting hole 624 and a second brush head spring mounting point 626 adjacent the fourth edge 686 of the base 621 with second brush head spring mounting point 616 biased towards the first edge 690. The fourth edge 696 is formed with a ball shaft 698 with a shoulder 699 on both sides. The ball shaft 698 is formed to be received by the socket 688 of the first brush head 610 to form a joint and allows for one degree of freedom-rotation about the joint in the plane. Bristles 622 are fixedly attached to the base 621 and extend normal therefrom. The second brush head 620 is attached to the brush head base 630 through the use of fastener 633 which is inserted through the mounting hole 624 and rigidly attached to the second brush head mounting point 634 of the brush head base 630. The washer 631 is used between the fastener 633 and the second brush head 620.

The first and second brush head 610 and 620, respectively, are rotatably attached to the brush head base 630 at a predetermined position to allow the brush heads to rotate. The first and second brush head 610 and 620, respectively, are placed adjacent with the socket 688 and the ball shaft 698 in contact, where the ball shaft 698 is received by the socket 688 and can rotate. The shoulders 689 of the first brush head and shoulders 699 of the second brush head, respectively, prevents the first brush head 610 and second brush head 620 from rotating beyond a maximum brush angle 660 of one hundred and eighty (180) degrees and a minimum brush angle 660. The first brush head 610 and the second brush head 620 rotates until the shoulders 689 and 699 come into contact thereby preventing further rotation. It is contemplated that the minimum and maximum brush angle 660 of the dynamic double action dual brush head 600 may be changed by modifying the socket 688, the ball shaft 698, and the shoulders 689 and 699.

In the alternative embodiment, a tension spring 650, is rigidly attached to the first brush head 610 and the second brush head 620. The tension spring 650 has a spring body 656 terminating at a first end 652 and a second end 654. The tension spring 650 is a coil spring, however it is not meant to be limiting and it is contemplated that any type of spring may be used. The first end 652 is rigidly attached to the first brush head 610 at the first brush head spring mounting point 616 and the second end 654 is rigidly attached to the second brush head 620 at the second brush head spring mounting point 626 with fasteners 658. The cavity 636 of the brush head base 630 provides a space for the tension spring 650 to reside since the brush head base 630 is substantially flush with the first brush head 610 and the second brush head 620. The first brush head 610 rotates about the first brush head mounting hole 614 and the second brush head 620 rotates about the second brush head mounting hole 624, and since the tension spring 650 is rigidly attached ahead of the point of rotation of both brush heads, the tension spring 650 pulls and rotates the first brush head 610 and the second brush head 620 inwards and maintains the first brush head 610 and the second brush head 620 at the minimum brush angle 660 under tension.

Figure 24:
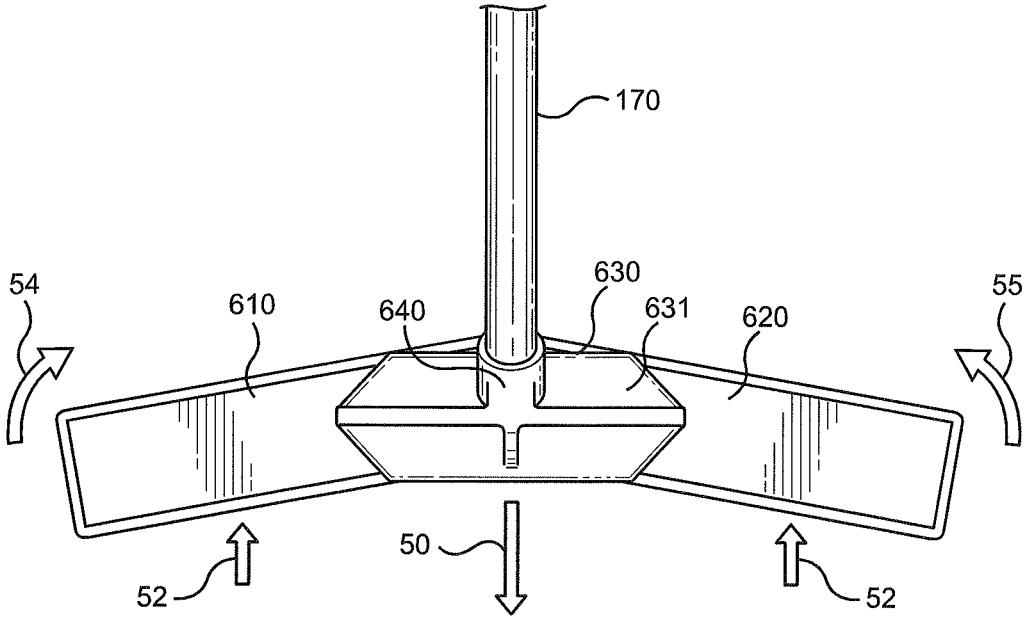
FIG. 24 is a top view of the alternative embodiment of the double action push broom with the alternative embodiment of the dynamic double action dual brush head at the start of a sweeping stroke.
Figure 25:
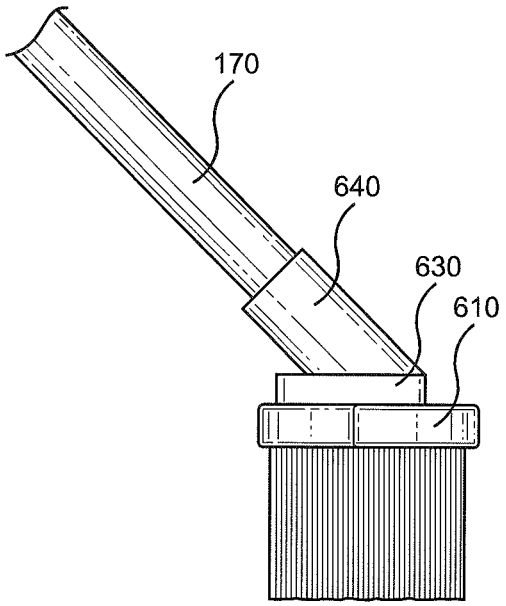
FIG. 25 is a side view of the alternative embodiment of the double action push broom with the alternative embodiment of the dynamic double action dual brush head at the start of a sweeping stroke.
Figure 26:
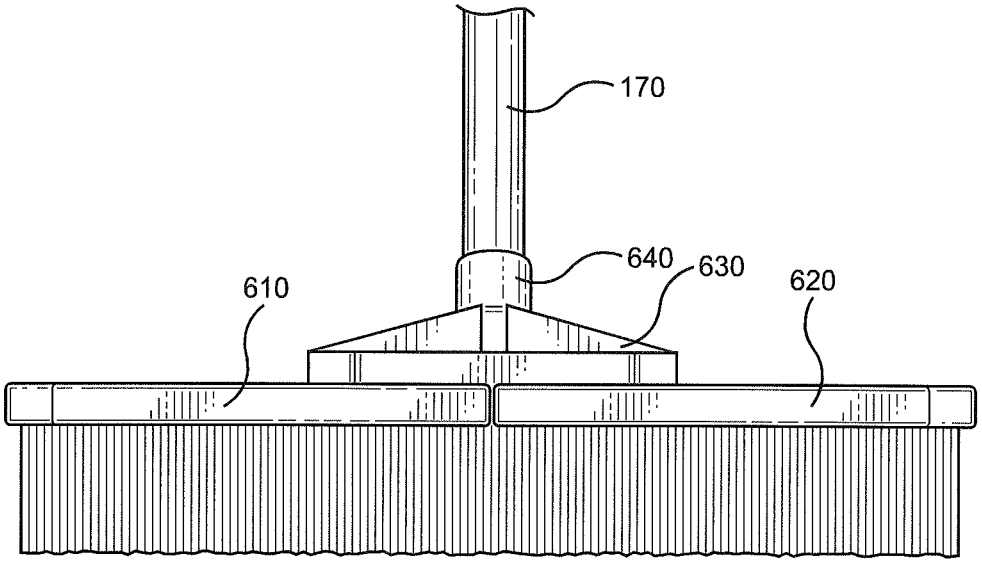
FIG. 26 is a front view of the alternative embodiment of the double action push broom with the alternative embodiment of the dynamic double action dual brush head at the start of a sweeping stroke.

Referring now to FIGS. 24, 25, and 26, the double action push broom 10 with the alternative embodiment of the dynamic double action dual brush head 600 is shown pushed in a forward direction 50 by a user. Before a user begins pushing the double action push broom 10, the double action push broom 10 is at rest and the brush angle 660 between the first brush head 610 and second brush head 620 is at its original, minimum angle at rest position 60 as shown in FIG. 21 and FIG. 22. As the user begins pushing the double action push broom 10, the force exerted by the user is transferred from the broom handle 170 to the bristles 612 and 622 of the first and second brush head 610 and 620, respectively.

Due to the twenty-two (22) degree angle of the broom handle 170, the force has a vertical and horizontal component. The horizontal component of the force pushes the broom towards direction 50 while the vertical component creates friction between the bristles 612 and 622 of the first and second brush 610 and 620 and the surface being swept. The friction counteracts the horizontal component of the force by producing an opposite force 52. However, as the user applies more force, the friction is eventually overcome and the broom 10 begins to advance in direction 50. The counteracting force 52 acts on the first brush head 610 and the second brush head 620 thereby rotating the first brush head 610 and the second brush head 620 along their respective axis of rotation.

The counteracting force 52 rotates the first brush head 610 in direction 54 and second brush head 620 in direction 55 along its axis of rotation. As the brush heads rotate, distance between the first brush head spring mounting point 616 and the second brush head spring mounting point 626 is increased thereby stretching the tension spring 650. Provided an adequate amount of counteracting force 52 is present, the first brush head 610 and second brush head 620 may rotate until the maximum brush angle 660 is achieved. In the preferred embodiment, the maximum brush angle 660 is one-hundred eighty (180) degrees. At its maximum brush angle 660, the shoulders 689 and 699 of the first brush head 610 and second brush head 620, respectively, come into contact to prevent further rotation, providing a straight brush with the longest available width. As discussed above, the maximum brush angle 660 may be varied to meet the requirements of the broom 10.

Once the user stops moving the broom 10 in direction 50 and the force stops, the mechanical potential energy of the stretched tension spring 650 is released and transferred back into the dynamic double action dual brush head 600, providing force and rotating the first brush head 610 and second brush head 620 inward along its respective axis of rotation to the initial rest angle of the dynamic double action dual brush head 600. The conversion of force from potential to kinetic energy results in the rotation of the dynamic double action dual brush head 600 from its prior position to its original angle at position 60, creating the additional sweeping motion which dramatically improves the effectiveness of the double action push broom 10 over traditional push brooms.

Referring now to FIGS. 27-31, a bottom view of several alternative embodiments of the bristles of the present invention is shown. As shown in the FIGS. 27-31, each alternative embodiment of the bristles have different arrangements, different bristle area densities, or have different types of bristles on one brush. For clarity, the different bristles are represented by different shading types in each figure. As shown in FIGS. 27-31, the bristles are attached to the dynamic double action dual brush head 600, however it is contemplated that the bristles may be attached to any embodiment of the dynamic double action dual brush head. The bristles are made of a firm, flexible and durable material such as polyethylene terephthalate (PET), polypropylene, or any other material having similar physical characteristics and properties. The physical characteristics and properties of the bristles may be modified to accommodate different surfaces and uses. Harder bristles are used for heavy duty cleaning and softer bristles for use on more sensitive surfaces.

Figure 27:
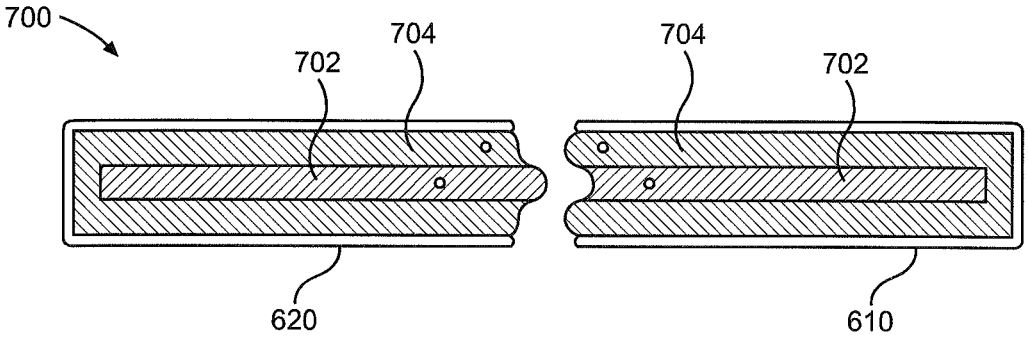
FIG. 27 is a bottom view of the alternative embodiment of the dynamic double action dual brush head with bristles having alternative properties.

As shown in FIG. 27, the bristles 700 include vertically oriented bristles 702 and angled bristles 704. The vertically oriented bristles 702 extend normal from the first brush head 610 and the second brush head 620. The angled bristles 704 are angled in a direction away from the center of the first brush head 610 and the second brush head 620, where at the edges the angled bristles 704 extend past the first brush head 610 and the second brush head 620 creating a brush head with a larger cleaning surface area.

Figure 28:
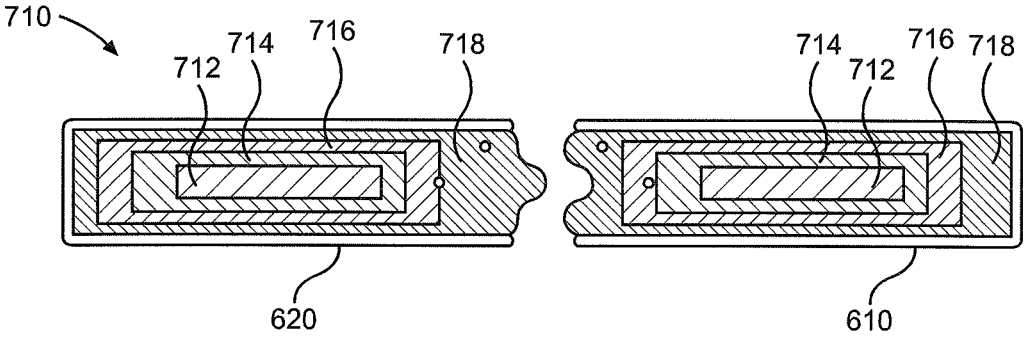
FIG. 28 is a bottom view of the alternative embodiment of the dynamic double action dual brush head with bristles having alternative properties.

As shown in FIG. 28, the bristles 710 include several sections of bristles 710 organized in concentric rectangles with each section having different properties from the other sections. The bristles 710 include a first section of bristles 712, a second section of bristles 714, a third section of bristles 716, and a fourth section of bristles 718. The properties of each section of bristles may vary, including the strength, the orientation, the area density, and the type of bristles 710. For example, the first section of bristles 712 may include the hardest bristle and the fourth section of bristles 718 may include the softest bristle, with the second section of bristles 714 and the third section of bristles 716 somewhere in between. Alternatively, the first section of bristles 712 may be the most densely packed area and the fourth section of bristles 718 having the least densely packed area, with the second section of bristles 714 and the third section of bristles 716 somewhere in between. The properties of each section of bristles, including the strength, the orientation, the area density, and the type of bristles 710 is not meant to be limiting, and it is contemplated that the properties may vary to meet specific needs.

Figure 29:
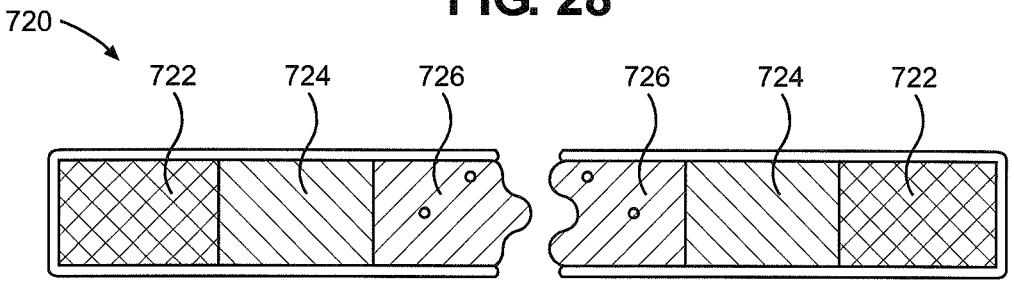
FIG. 29 is a bottom view of the alternative embodiment of the dynamic double action dual brush head with bristles having alternative properties.

As shown in FIG. 29, the bristles 720 include several sections of bristles 720 with each section having different properties from the other sections. The bristles 720 include a first section of bristles 722, a second section of bristles 724, and a third section of bristles 726 on each of said first brush head 610 and second brush head 620. The first section of bristles 722 having the hardest bristles 720 is located at the outermost edges of the first brush head 610 and second brush head 620 and the third section of bristles 762 having the softest bristles is located at the innermost edges of the first brush head 610 and second brush head 620, with the second section of bristles 724 with bristles 720 having a medium hardness is located in between. This creates the dynamic double action dual brush head 600 with a center section having soft bristles 720 and harder bristles 720 towards the edges. It is contemplated that the bristles 720 may different varying properties between each section, such as the strength, the orientation, the area density, and the type of bristles 720 to meet specific needs.

Figure 30:
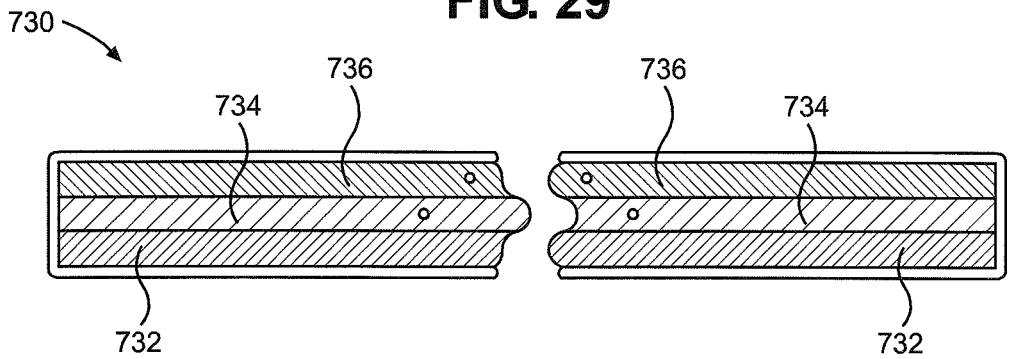
FIG. 30 is a bottom view of the alternative embodiment of the dynamic double action dual brush head with bristles having alternative properties.

As shown in FIG. 30, the bristles 730 include several sections of bristles 730 with each section having different properties from the other sections. The bristles 730 include a first section of bristles 732, a second section of bristles 734, and a third section of bristles 736 on each of said first brush head 610 and second brush head 620. The first section of bristles 732 having the hardest bristles 730 is located at the back of the first brush head 610 and second brush head 620 and the third section of bristles 736 having the softest bristles is located at the front of the first brush head 610 and second brush head 620, with the second section of bristles 734 with bristles 730 having a medium hardness is located in between. This creates the dynamic double action dual brush head 600 with a front section having soft bristles 730 and harder bristles 730 towards the back. It is contemplated that the bristles 730 may different varying properties between each section, such as the strength, the orientation, the area density, and the type of bristles 730 to meet specific needs.

Figure 31:
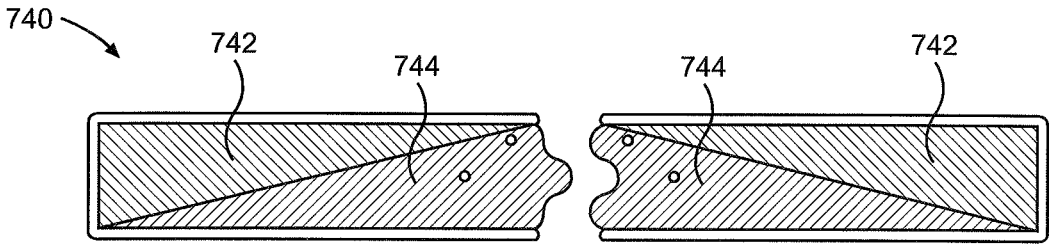
FIG. 31 is a bottom view of the alternative embodiment of the dynamic double action dual brush head with bristles having alternative properties.

As shown in FIG. 31, the bristles 740 include two sections of bristles 740 with each section having different properties from the other. The bristles 740 include a first section of bristles 742 and a second section of bristles 744 on each of said first brush head 610 and second brush head 620. The first section of bristles 742 and the second section of bristles 744 are split evenly at a diagonal of the first brush head 610 and the second brush head 620. The first section of bristles 742 having the hardest bristles 740 is located at the front of the first brush head 610 and second brush head 620 and the second section of bristles 744 having the softest bristles is located at the back of the first brush head 610 and second brush head 620. This creates the dynamic double action dual brush head 600 with the edges having hard bristles in order to increase the ability of the broom to pick up dirt at the edges. It is contemplated that the bristles 730 may different varying properties between each section, such as the strength, the orientation, the area density, and the type of bristles 730 to meet specific needs.

Figure 32:
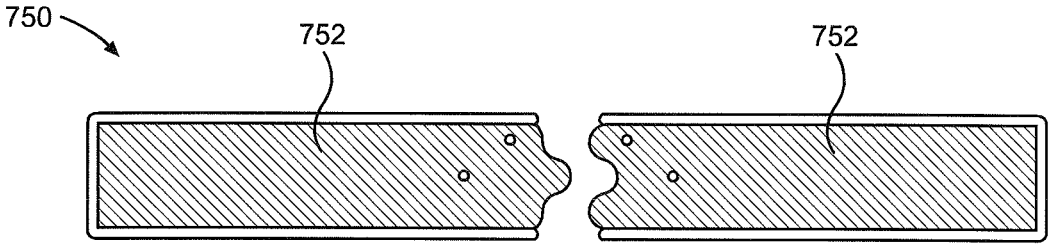
FIG. 32 is a bottom view of the alternative embodiment of the dynamic double action dual brush head with a chamois cleaning surface.
Figure 33:
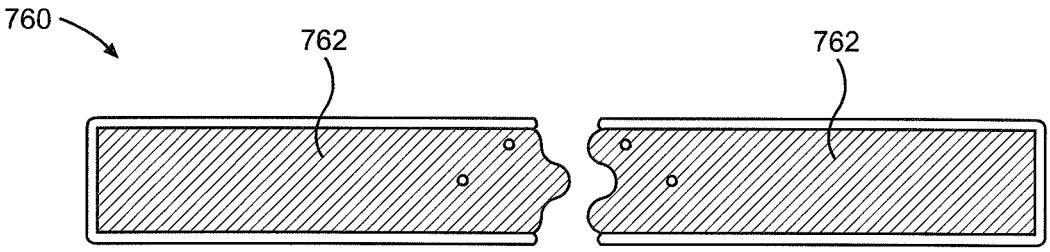
FIG. 33 is a bottom view of the alternative embodiment of the dynamic double action dual brush head with a microfiber cleaning surface.
Figure 34:
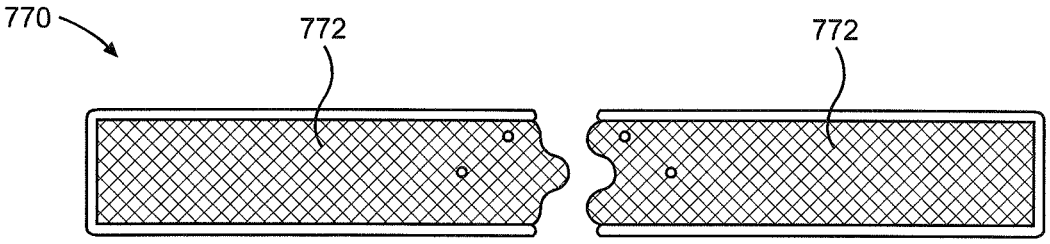
FIG. 34 is a bottom view of the alternative embodiment of the dynamic double action dual brush head with a sponge cleaning surface.

Referring now to FIG. 32-34, a bottom view of several alternative embodiments of the cleaning surface of the present invention is shown. As shown in the FIGS. 32-34, each alternative embodiment includes a different cleaning surface; the cleaning surfaces are represented by different shading in each figure for clarity. As shown in FIGS. 32-34, the cleaning surfaces are attached to the dynamic double action dual brush head 600, however it is contemplated that the bristles may be attached to any embodiment of the dynamic double action dual brush head. As shown in FIG. 32, the cleaning surface 750 is made of chamois material 752 to enable the broom to be used as a dust broom on soft surfaces. As shown in FIG. 33, the cleaning surface 760 is made of microfiber material 760 to enable the broom to be used to clean soft surfaces or dry surfaces. As shown in FIG. 34, the cleaning surface 770 is made of a sponge material 772 to enable the broom to be used as a mop. It is contemplated that the cleaning surface may be any other material, without departing from the spirit and scope of the invention. It is also contemplated the cleaning surface material may be organized as described in FIG. 27-31 above.

Figure 35:
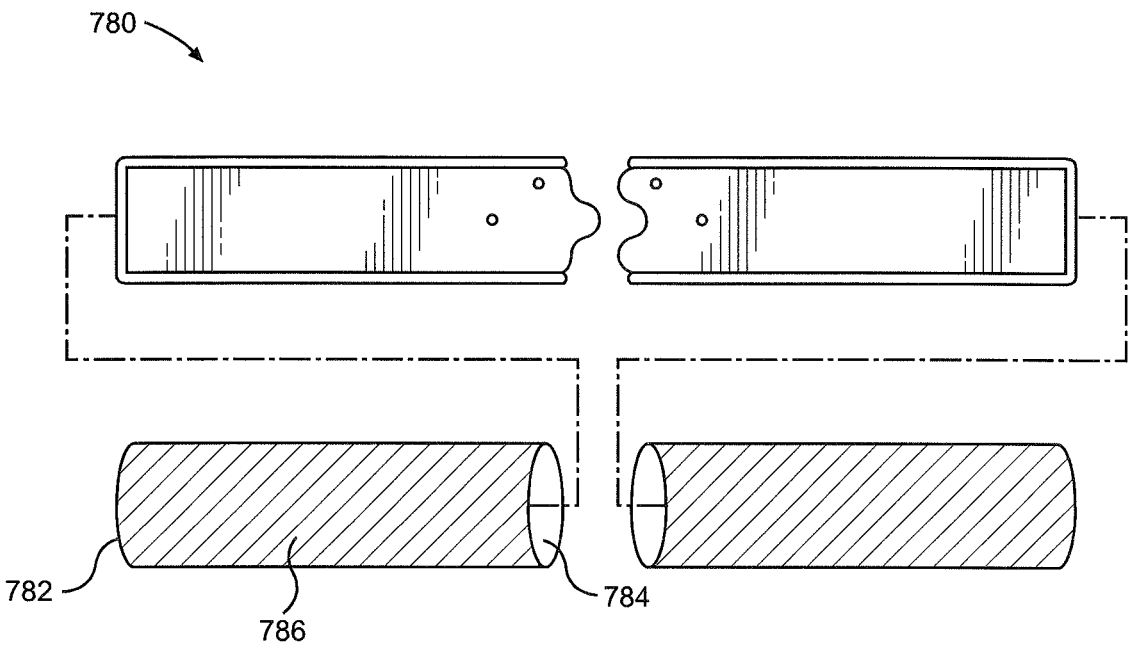
FIG. 35 is a bottom view of the alternative embodiment of the dynamic double action dual brush head with a detachable cleaning surface.

Referring now to FIG. 35, a bottom view of an alternative embodiment of the cleaning surface of the present invention is shown. As shown in the FIG. 35, the first brush head 610 and the second brush head 620 is void of a cleaning surface. Instead, cleaning pads 782 are attached to the first brush head 610 and the second brush head 620. The cleaning pads 782 includes a hollow body 784 with a cleaning surface 786, which may be of any material described above. To attach the cleaning pads 782 to the first brush head 610 and the second brush head 620, the cleaning pads 782 are slipped over the first brush head 610 and the second brush head 620. It is contemplated that the cleaning pads 782 may be attached to the brush head 610 and the second brush head 620 void of a cleaning surface by any method known in the art. The cleaning pads 782 are removable from the dynamic double action dual brush head 600 to change to a different type of cleaning pad 782 for a different surface, to clean the cleaning pad 782, or to discard the cleaning pad 782 for a new one.

Figure 36:
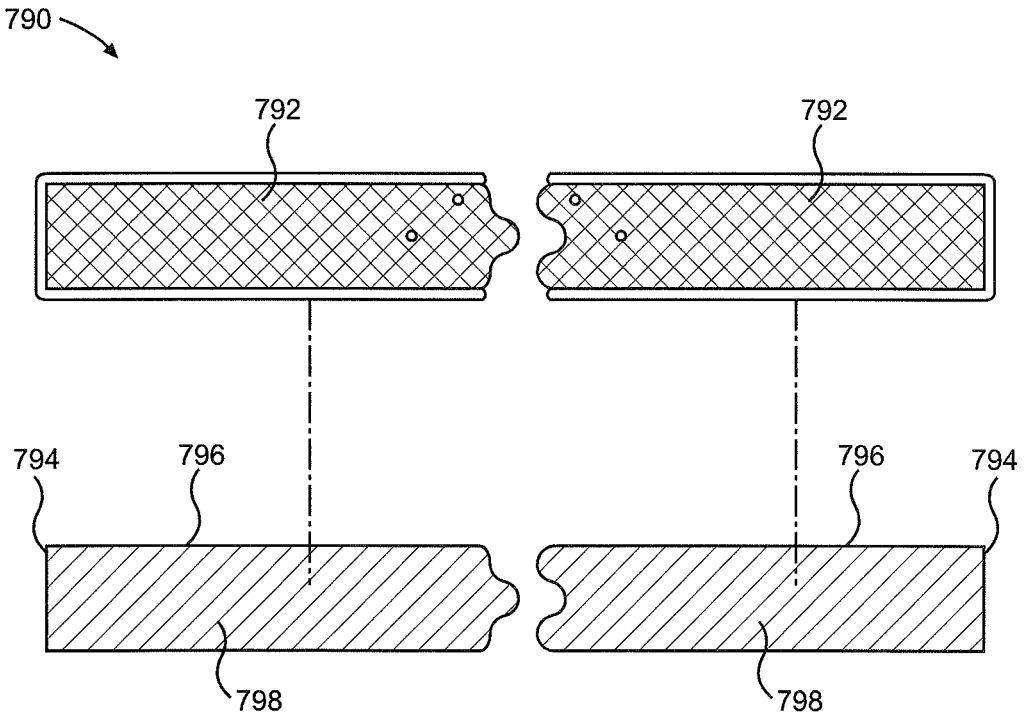
FIG. 36 is a bottom view of the alternative embodiment of the dynamic double action dual brush head with an alternative embodiment of the detachable cleaning surface.

Referring now to FIG. 36, a bottom view of an alternative embodiment of the cleaning surface of the present invention is shown. As shown in the FIG. 36, the first brush head 610 and the second brush head 620 is void of a cleaning surface and instead includes a surface of hook fasteners 792. Cleaning pads 794 are attached to the first brush head 610 and the second brush head 620. The cleaning pads 794 includes a top surface of loop fasteners 796 and a bottom cleaning surface 798, which may be of any material described above. To attach the cleaning pads 794 to the first brush head 610 and the second brush head 620, the top surface of loop fasteners 794 of the cleaning pads 794 are attached to the loop fasteners of the first brush head 610 and the second brush head 620. The cleaning pads 794 are removable from the dynamic double action dual brush head 600 to change to a different type of cleaning pad 782 for a different surface, to clean the cleaning pad 782, or to discard the cleaning pad 782 for a new one.

While there have been shown what are presently considered to be preferred embodiments of the present invention, it will be apparent to those skilled in the art that various changes and modifications can be made herein without departing from the spirit and scope of the invention.

I claim:

1. A double action cleaning tool comprising:

a first brush head comprising a base haying a perimeter edge defined by a first edge, a second edge, a third edge, and a fourth edge with a mounting hole formed into said base adjacent said fourth edge;

a second brush head comprising a base haying a perimeter edge defined by a first edge, a second edge, a third edge, and a fourth edge with a mounting hole formed into said base adjacent said fourth edge;

a brush head base comprising a base formed with a first brush head mounting point, a second brush head mounting point, and a handle mount, wherein said mounting hole of said first brush head is attached to said first brush head mounting point and said mounting hole of said second brush head is attached to said second brush head mounting point, wherein said fourth edge of said first brush head is adjacent to and in contact with said fourth edge of said second brush head at a brush head angle between said first brush head and second brush head;

a mechanical energy storage device attached to said first brush head and said second brush head;

a handle connected to said handle mount; and wherein said first brush head and said second brush head are configured to rotate in the same plane, the first and second brush heads are biased into neutral positions which define the brush head angle and each brush head is adapted to deflect in use upon application of a force and return to the neutral position when the force is removed.

2. The double action cleaning tool of claim 1, wherein said first brush head and said second brush head are configured to rotate at equal angular velocities and equal degrees of rotation in the same plane.

3. A double action cleaning tool comprising:

a double action dual brush head comprising a brush head base comprising a base with a first brush head mounting point, a second brush head mounting point, and a handle mount, a first brush head comprising a base haying a perimeter edge defined by a first edge, a second edge, a third edge, and a fourth edge with a mounting hole formed into said base adjacent said fourth edge, a second brush head comprising a base having a perimeter edge defined by a first edge, a second edge, a third edge, and a fourth edge with a mounting hole formed into said base adjacent said fourth edge, a spring attached to said first brush head and said second brush head, wherein said first brush head is attached to said brush head base by attaching said mounting hole of said first brush head to said first brush head mounting point and said second brush head is attached to said brush head base by attaching said mounting hole of said second brush head to said second brush head mounting point, wherein said fourth edge of said first brush head is adjacent to and in contact with said fourth edge of said second brush head at a brush head angle between said first brush head and second brush head;

a handle connected to said handle mount of said double action dual brush head; and wherein said first brush head and said second brush head are configured to rotate in the same plane, the first and second brush heads are biased into neutral positions which define the brush head angle and each brush head is adapted to deflect in use upon application of a force and return to the neutral position when the force is removed.

4. The double action cleaning tool of claim 3, wherein said first brush head and said second brush head are configured to rotate at equal angular velocities and equal degrees of rotation in the same plane.

5. The double action cleaning tool of claim 4, wherein said fourth edge of said first brush head has a first brush head straight section and a first brush head gear teeth section and said fourth edge of said second brush head has a second brush head straight section and a second brush head gear teeth section, wherein said first brush head gear teeth section meshes with said second brush head gear teeth section.

6. The double action cleaning tool of claim 3, wherein said fourth edge of said first brush head is formed with a socket and said fourth edge of said second brush head is formed with a ball shaft, wherein said ball shaft is received by said socket.

7. A double action cleaning tool comprising:

a brush head base, said brush head base comprises a plate having a top surface and a bottom surface, said plate is formed with a first brush head mounting point, a second brush head mounting point, and a cavity in said bottom surface of said plate;

a first brush head attached to said brush head base, said first brush head comprises a base having a perimeter edge defined by a first edge, a second edge, a third edge, and a fourth edge, wherein said fourth edge is formed with a socket, a first brush head mounting hole is formed into said base adjacent said fourth edge, and a first brush head spring mounting point is formed into said base adjacent said fourth edge and biased towards said first edge;

a second brush head attached to said brush head base, said second brush head comprises a base having a perimeter edge defined by a first edge, a second edge, a third edge, and a fourth edge, wherein said fourth edge is formed with a ball shaft, a second brush head mounting hole is formed into said base adjacent said fourth edge, and a second brush head spring mounting point is formed into said base adjacent said fourth edge and biased towards said first edge, said first brush head and said second brush head forming a brush head angle between said first brush head and said second brush head, and wherein said first brush head and said second brush head are configured to rotate in the same plane, the first and second brush heads are biased into neutral positions which define the brush head angle and each brush head is adapted to deflect in use upon application of a force and return to the neutral position when the force is removed;

a handle attached to said brush head base; and wherein said first brush head is attached to said brush head base at said first brush head mounting point and said second brush head is attached to said brush head base at said second brush head mounting point, wherein said ball shaft is received by said socket.

8. The double action cleaning tool of claim 7, further comprising a tension spring having a spring body terminating at a first end and at a second end, said first end of said tension spring is attached to said first brush head spring mounting point and said second end of said tension spring is attached to said second brush head spring mounting point.

* * * * *